US010292471B2

(12) United States Patent
Zoland

(10) Patent No.: US 10,292,471 B2
(45) **Date of Patent: *May 21, 2019**

(54) BAG EXPANDERS

(71) Applicant: Martin Zoland, South Melbourne (AU)

(72) Inventor: Martin Zoland, South Melbourne (AU)

( * ) Notice: Subject to any disclaimer, the term of this patent is extended or adjusted under 35 U.S.C. 154(b) by 61 days.

This patent is subject to a terminal disclaimer.

(21) Appl. No.: 15/075,393

(22) Filed: Mar. 21, 2016

(65) Prior Publication Data

US 2016/0331094 A1 Nov. 17, 2016

Related U.S. Application Data

(60) Provisional application No. 62/161,183, filed on May 13, 2015.

(51) Int. Cl.
*A45C 13/00* (2006.01)

(52) U.S. Cl.
CPC ..... *A45C 13/004* (2013.01)

(58) Field of Classification Search
CPC ..... A45C 13/004; A45C 13/34; A45C 13/345; A45C 7/02; B65D 5/724; B65D 25/10; B65D 25/101
USPC ..... 383/127, 33; 150/900; 220/94, 528–532, 220/534–550, 554, 559; 211/51, 59.3, 211/85; 221/279; 206/525, 758, 761, 206/556, 817, 814
See application file for complete search history.

(56) References Cited

U.S. PATENT DOCUMENTS 1,135,282 A * 4/1915 Hernandez ..... B42F 17/02 211/43
2,019,636 A * 11/1935 Scrantom ..... B60R 9/065 190/107
2,185,605 A * 1/1940 Murphy ..... B65D 75/54 206/252
2,798,579 A * 7/1957 Fox ..... A45C 7/0077 190/107
3,410,328 A * 11/1968 Sasai ..... B65D 7/26 108/145
4,077,451 A * 3/1978 Zoland ..... A45C 13/004 140/106
4,141,399 A * 2/1979 Zoland ..... A45C 13/004 190/106

(Continued)

*Primary Examiner* — Jes F Pascua
*Assistant Examiner* — Nina K Attel
(74) *Attorney, Agent, or Firm* — Lewis B. Sternfels

(57) ABSTRACT

A bag expander is preliminarily inserted into a bag when the bag is in a compressed condition, such as for shipping and/or storage. The expander is expanded within the bag when the bag is to be expanded such as for purposes of display for sale. The expander includes side walls which are positionable against the bag interior and coupling members articularly connected together and to the side walls. One or more rubber bands or other spring mechanisms are coupled to the members to urge them apart when the expansion is desired. The members are folded when the bag is compressed and expanded by the rubber band or the like to expand the bag to its expanded displayable condition. Sliding mechanisms are connected either (a) on and within the interior of the members or (b) between the members and the side walls to provide a selected sliding movement (a) amongst the members themselves or (b) between the members and the side walls to enable the expander to be placed in its collapsed or extended position.

31 Claims, 25 Drawing Sheets

(56) References Cited

U.S. PATENT DOCUMENTS 4,142,564 A * 3/1979 Zoland ..... A45C 13/004 190/106
4,599,832 A * 7/1986 Benton ..... B64G 9/00 5/99.1
4,946,292 A * 8/1990 Diamond ..... A45C 13/004 190/106
4,957,213 A * 9/1990 White ..... B42F 17/14 206/425
4,969,751 A * 11/1990 Diamond ..... A45C 13/004 190/106
4,993,846 A * 2/1991 Diamond ..... A45C 13/004 190/106
5,030,014 A * 7/1991 Diamond ..... A45C 13/004 190/106
5,179,600 A * 1/1993 Bailey ..... A45C 13/004 150/900
5,259,674 A * 11/1993 Hedaya ..... A45C 13/004 383/127
5,292,197 A * 3/1994 Reisman ..... A45C 13/004 383/127
5,322,362 A * 6/1994 Smith ..... A45C 13/004 383/127
5,350,241 A * 9/1994 Zoland ..... A45C 13/004 383/127
5,400,906 A * 3/1995 Tang ..... A45C 13/004 206/457
5,499,874 A * 3/1996 Tang ..... A45C 13/004 383/127
5,542,767 A * 8/1996 Hedaya ..... A45C 13/004 383/127
5,758,974 A * 6/1998 Markowitz ..... A45C 13/004 383/127
6,022,146 A * 2/2000 Bull ..... A45C 13/004 383/127
6,102,570 A * 8/2000 Bull ..... A45C 13/004 383/127
6,213,643 B1 * 4/2001 Lin ..... A45C 13/004 229/122.23
6,550,967 B2 * 4/2003 Hedaya ..... A45C 13/004 383/127
6,698,927 B2 * 3/2004 Hedaya ..... A45C 13/004 383/127
7,699,149 B2 * 4/2010 Lin ..... A45C 7/0022 190/103
2006/0233472 A1 * 10/2006 Encarnacion ..... A45C 13/02 383/127
2007/0131682 A1 * 6/2007 Liu ..... B65D 37/00 220/9.1
2008/0137999 A1 * 6/2008 Chi ..... A45C 7/0063 383/127
2015/0166249 A1 * 6/2015 McDonald ..... B65D 83/0858 206/758
2016/0331094 A1 * 11/2016 Zoland ..... A45C 13/004

* cited by examiner

BAG EXPANDERS

CROSS-REFERENCE TO RELATED APPLICATION

This application claims the benefit of U.S. Provisional Application No. 62/161,183 filed 13 May 2015 entitled "Bag Expanders."

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

The present invention relates an apparatus and method for permitting the shipment of flexible sided bags such as cosmetic bags, purses, soft-sided luggage and handbags from a flattened condition to an expanded condition, e.g., to present an attractive appearance at the point of sale, by bag expender implementation contained within the bag.

2. Description of Related Art and Other Considerations

In shipping of merchandise, freight payments are made, not only with respect to weight, but also with respect to volume. Commercial transport of goods is normally charged by volume as well as by weight of the goods. Articles, such as bags, are conventionally collapsed at the point of manufacture for transport and, therefore, can provide a distributor with significant cost savings. The disadvantage of such collapsible goods, however, is that on reaching their destination they invariably need to be expanded so as to present an attractive appearance and thereby enhance sale prospects. At the point of sale, purchasers of collapsible goods normally spend an inordinate amount of time filling the goods with costly inserts and foam material so the goods can be presented in an expanded form. In addition to display, when the insert is used like a shoe tree, e.g., for an expensive handbag or the like, an expander expands the bag to help the bag retain its shape.

A number of devices have been proposed in the past to try to alleviate the above problems but most have either proved ineffective, relatively cumbersome and/or expensive to implement. Examples include those disclosed in U.S. Pat. Nos. 4,077,451, 4,141,399, 4,142,564, 4,993,846, 5,259,674 and 5,350,241. By providing a device which may be inserted in the bag at the point of manufacture and which may be expanded at the point of display and sale, the bag can be shipped flat and erected for a suitable attractive appearance at the point of sale.

SUMMARY OF THE INVENTION

These and other problems are successfully addressed and overcome by the present invention. The expander includes side walls which are positionable against the bag interior, members articularly connected together and to the side walls, a sliding mechanism connected either within the interior of the members or between members and the side walls to provide a selected sliding movement amongst the members themselves or between the members and the side walls. The sliding mechanism enables the expander to be deployed in a collapsed or extended position. The members are in a folded condition when the bag is compressed and, with the aid of a rubber band, spring or the like, the members enable the bag to be deployed to its expanded condition.

Several advantages are derived from this arrangement. Commercial costs of transport are significantly reduced over what was previously done. Display of the goods at the point of sale is facilitated with ease and in a timely manner. Should the goods need to be maintained in shape, such can be done easily.

Accordingly, an object of the present invention is to provide an effective and inexpensive expanding device for collapsible articles.

Other aims and advantages, as well as a more complete understanding of the present invention, will appear from the following explanation of exemplary embodiments and the accompanying drawings thereof.

Figure 1:
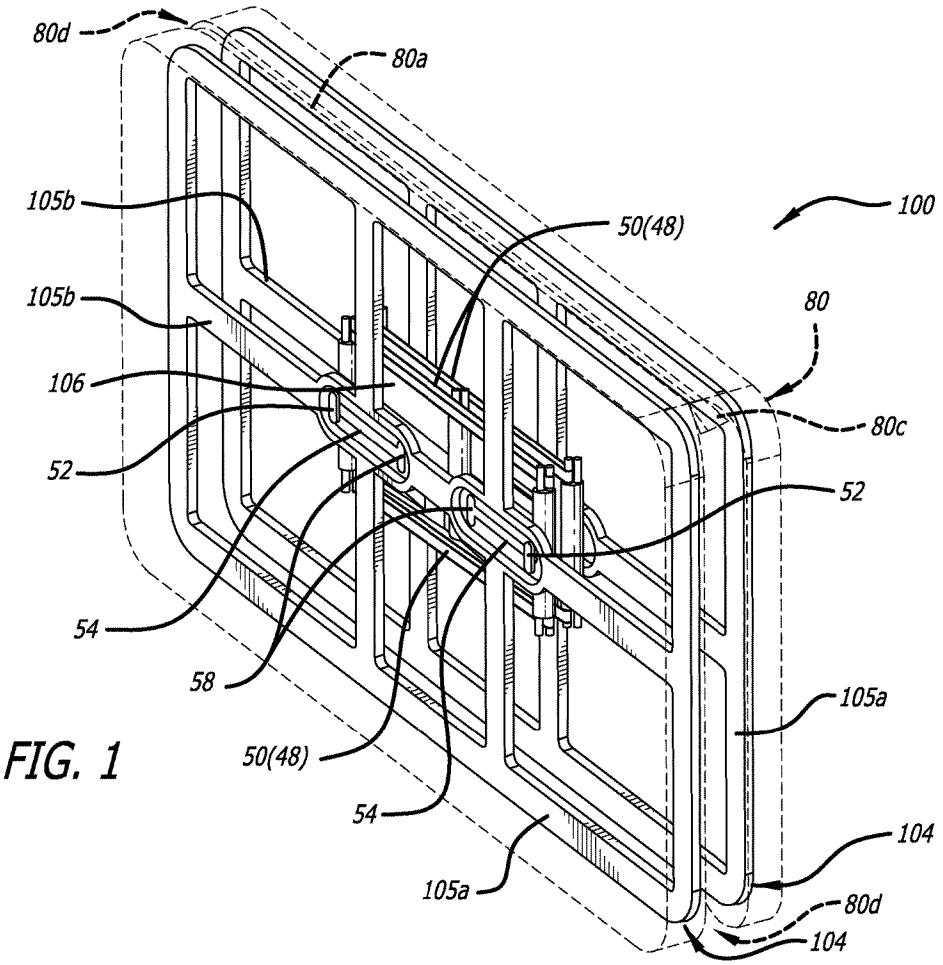
FIG. 1 is an isometric presentation of a first embodiment of the bag expander as compressed and contained in a receptacle or bag, which is depicted in phantom or dashed lines. Expansion of the bag expander is effected by an expansion motivator represented, as an example, in the form of a rubber band. The indicia utilized hereinafter in the first embodiment ranges within a 100 series. Indicia applicable to this and further embodiments are generally identified as residing within the range of a 40-99 series.
Figure 2:
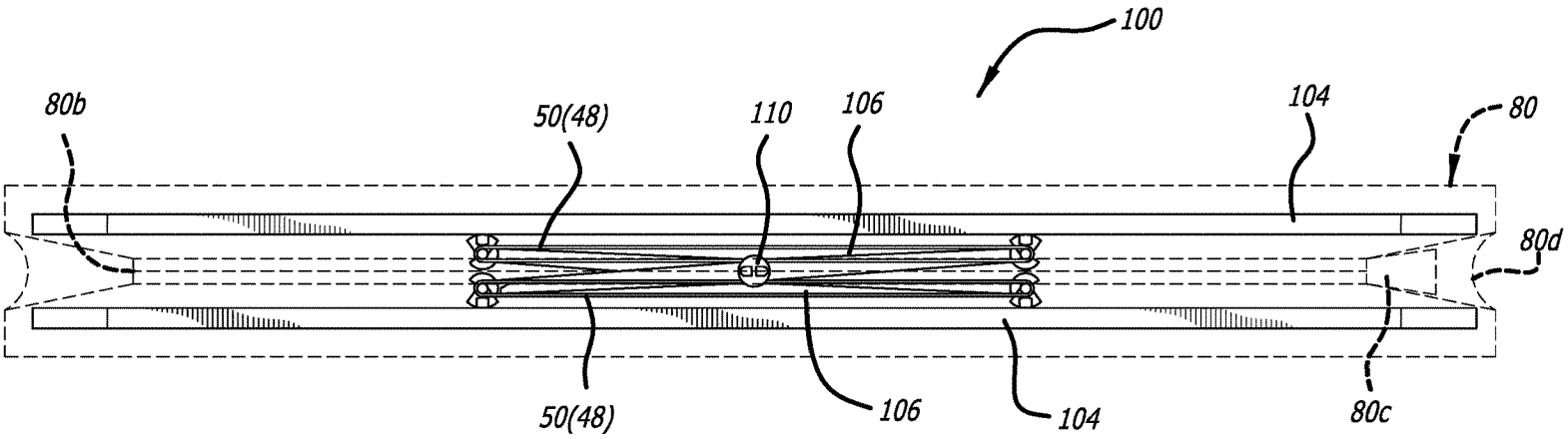
FIG. 2 is a top view of the first embodiment of FIG. 1 within the receptacle or bag, as fully compressed.
Figure 3:
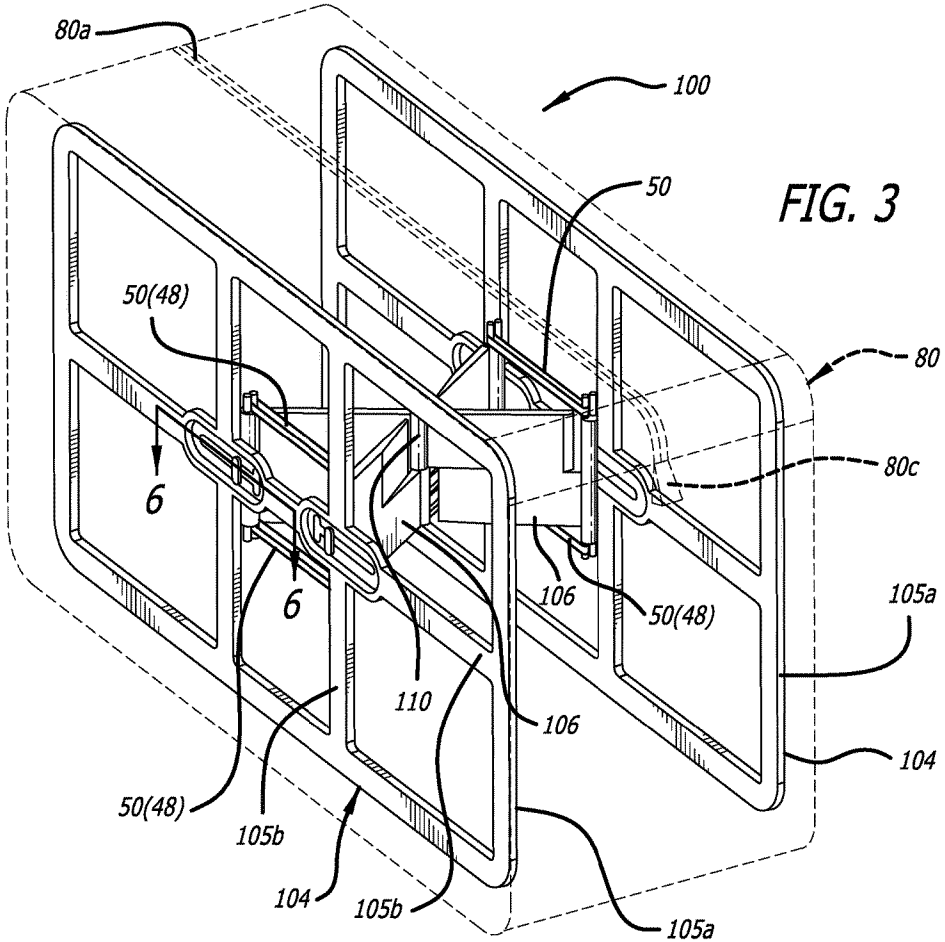
FIG. 3 is an isometric presentation of the first embodiment of FIG. 1 within the receptacle or bag, as fully expanded.
Figure 4:
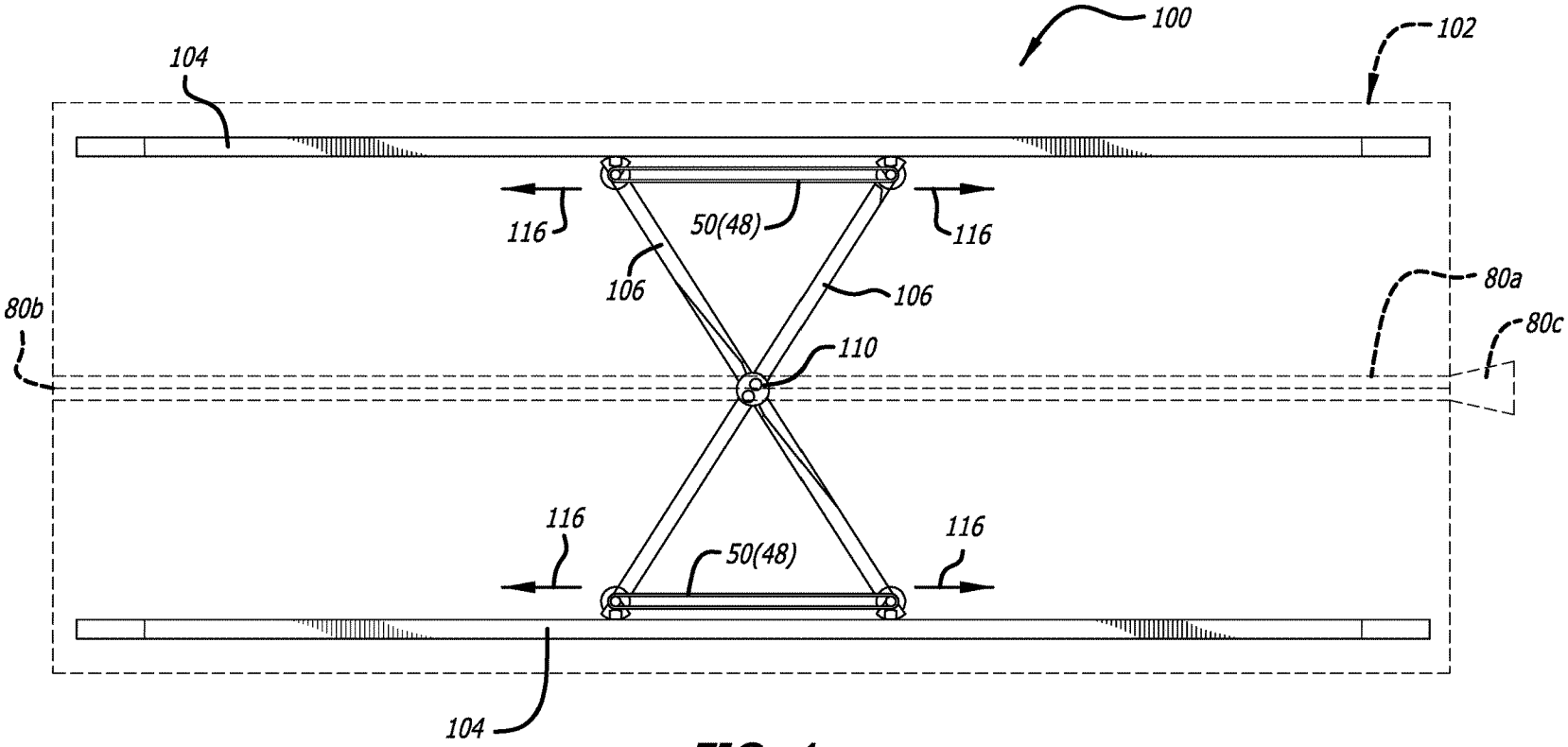
FIG. 4 is a top view of the first embodiment of FIG. 1 within the receptacle or bag, as fully expanded.

Where, however, a component is useful for incorporation within more than one embodiment as illustrated in FIGS. 1-33, that component may be identified within the indicia or numerical range of a two digit series, viz., 40-99. Specific or individual embodiments are denoted within three digit indicia or numerical ranges, that is, referenced within their respective 100 through 800 series. It is to be understood and intended, notwithstanding, that such employment of indicia or reference numerals is to be for descriptive and not limiting purposes.

DETAILED DESCRIPTION OF THE PREFERRED EMBODIMENTS

Figure 9:
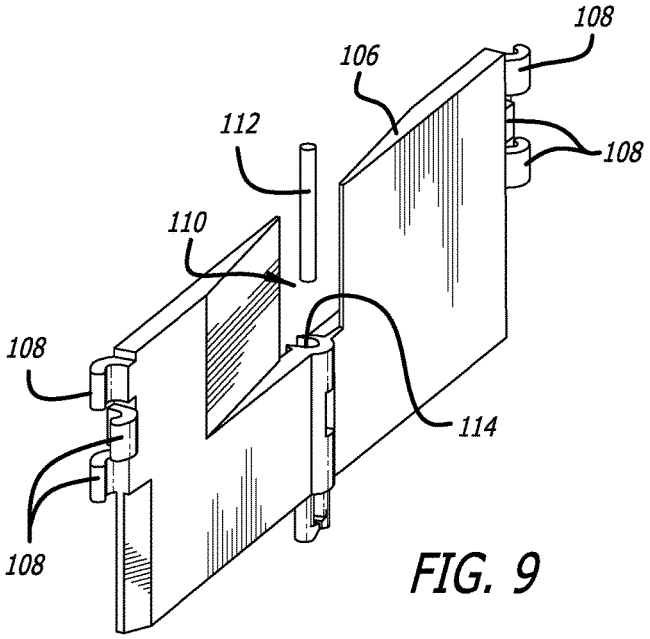
FIG. 9 is an isometric presentation a member used in the first embodiment of the bag expander.

Accordingly, as depicted in FIGS. 1-9 a bag expander 100 is shown as contained or otherwise positioned within a receptacle or bag 80, which is depicted in phantom or dashed lines. Bag 80, as modeled from U.S. Pat. No. 5,350,241 (which is referenced herein as if stated in haec verba), includes a zipper 80*a*, a zipper closed end 80*b*, a zipper tab 80*c* at the other or openable end opposed to end 80*b* and a gusset or gusset area 80*d*. The bag expander includes a pair of side walls 104 coupled together by several connecting members 106 (e.g., see FIGS. 3-5 and 9); in this embodiment members 106 cross one another as being shown as flat members. Side walls 104 may comprise a frame 105*a* supported by links 105*b* as shown in the FIG. 1 embodiment (e.g., see FIGS. 1 and 7) or as the similar embodiments in subsequent embodiments or solid pieces 604 and 704 as embodied in FIGS. 24-27. As best shown in FIG. 9 and partially shown in FIG. 5, each connecting member terminates at its opposed ends with alternately-directed generally C-shaped closures 108. Closures 108 are adapted to engage axle pins 40 as illustrated in detail in FIG. 8. Axle pins 40 are positioned between mating members 106 and side walls 104 and, because of their more universal use, are adaptable to other embodiments as will be hereinafter described. The axle pins include a pair of parallely extending legs 42 joined together by a plurality of spaced connecting pieces 44. Each leg 42 terminates in an end 46 or connecting point from which a projection 47 projects. Ends 46 on spaced axle pins, as selectively used, provide spaced connecting points for expansion motivators 48, here embodied as rubber bands 50. Projections 47 prevent the rubber bands from slipping off from ends 46.

For definition purposes, indicium 48 is used to generally denote an expansion motivator, however it may be composed as a specific component, here in several embodiments (FIGS. 1-23 and 31-33) as a rubber band 50. In further embodiments, viz., FIGS. 28-30, the specific expansion motivator (a spring) will be designated as "x (48)" where the letter "x" indicium will be later identified as a numeral indicium. Accordingly, when a specific expansion motivator is depicted in the drawings, its specific indicium will first be presented with the generally denoted expansion motivator in parenthesis, to wit, for a rubber band "50 (48)" and for a spring "x (48)."

Returning now to the first embodiment and to bag expander 100, legs 42 have at least a partial circular cross-section so as to provide an attaching point mechanism that enable C-shaped closures 108 to be pivotally connected to side walls 104, as will be presently described. Preferably centered on a leg 42 is a promontory 52, which is shaped as having one of a T-configuration or L-configuration, for example, and which is used as a connection component for coupling connecting members 106 to side walls 104 (e.g., see FIG. 6).

Figure 6:
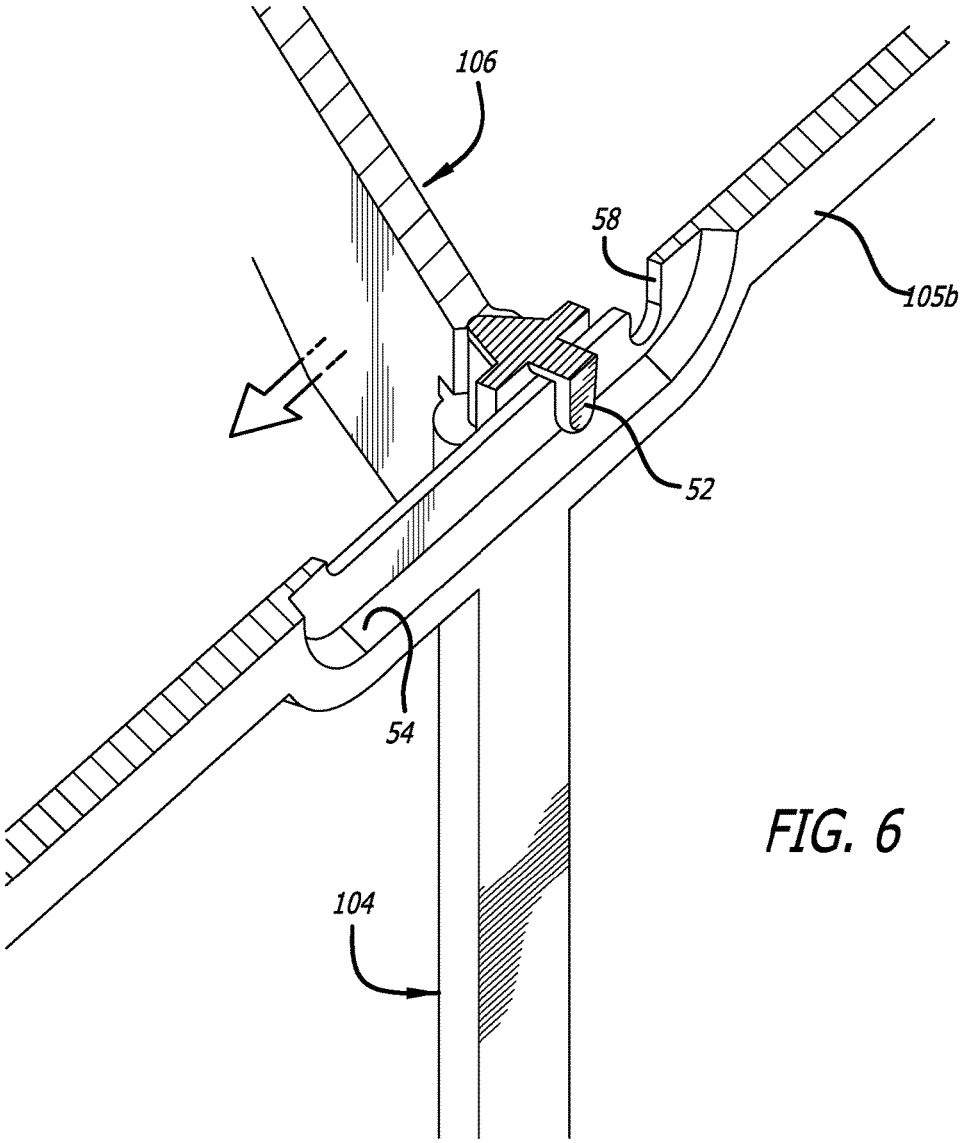
FIG. 6 is an isometric presentation in partial view of the sliding mechanism of FIG. 1, taken along line 6-6 of FIG. 3; however, this sliding mechanism is also employable in subsequent embodiments of the bag expander.
Figure 7:
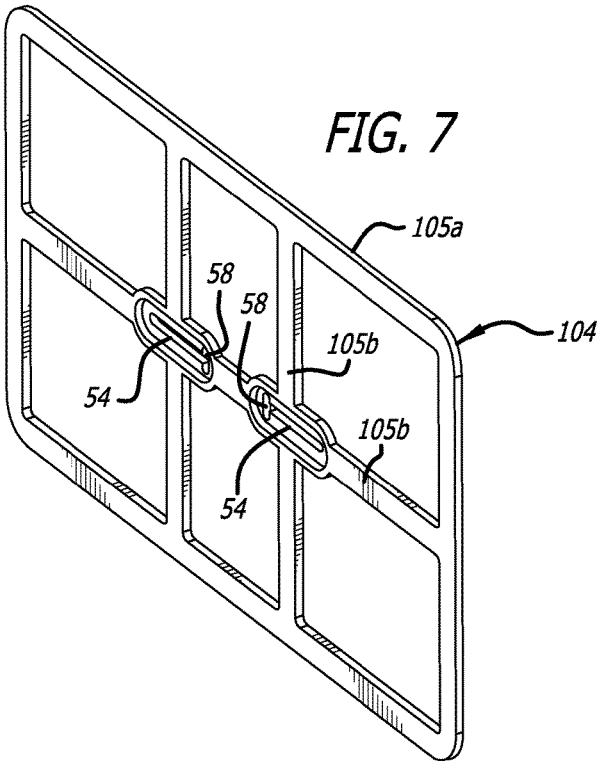
FIG. 7 is an isometric presentation view of a side wall used in the first and subsequent embodiments of the bag expander.
Figure 8:
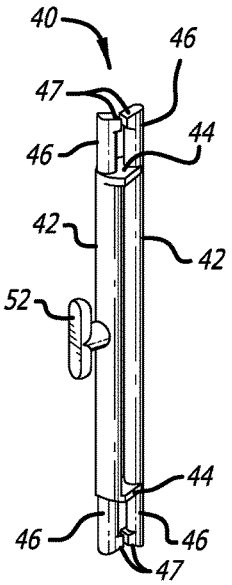
FIG. 8 is an isometric presentation an axle pin used in the first and subsequent embodiments of the bag expander.

As readily viewed in FIG. 6, the pivotal coupling of selected connecting members 106 to side walls 104 is effected and completed by the providing of slots 54 formed within links 105*b* of side walls 104. Each slot 54 has an entry 58 for enabling its mating promontory 52 to enter and engage in a sliding coupling therebetween. As a result of this sliding coupling, bag expander 100 as well as all bag expanders in subsequently described and depicted embodiments can expand or contract between its compressed and expended states as respectively illustrated in FIGS. 1 and 2 and in FIGS. 3 and 4 and as suggested by arrow-headed lines 116 of FIG. 4.

Here, for purposes of defining the sliding mechanism, slot 54 is used to generally denote one sliding mechanism component and promontory or tongue 52 as its mating sliding mechanism component, however the sliding mechanism may be composed. Thus, in several embodiments (FIGS. 1-27) slot 54 is configured as ending with opening 58 which is T-shaped (FIGS. 1-23). In further embodiments, FIGS. 24-27, the specific opening (a V-shaped opening) is identified by indicium 60.

Figure 5:
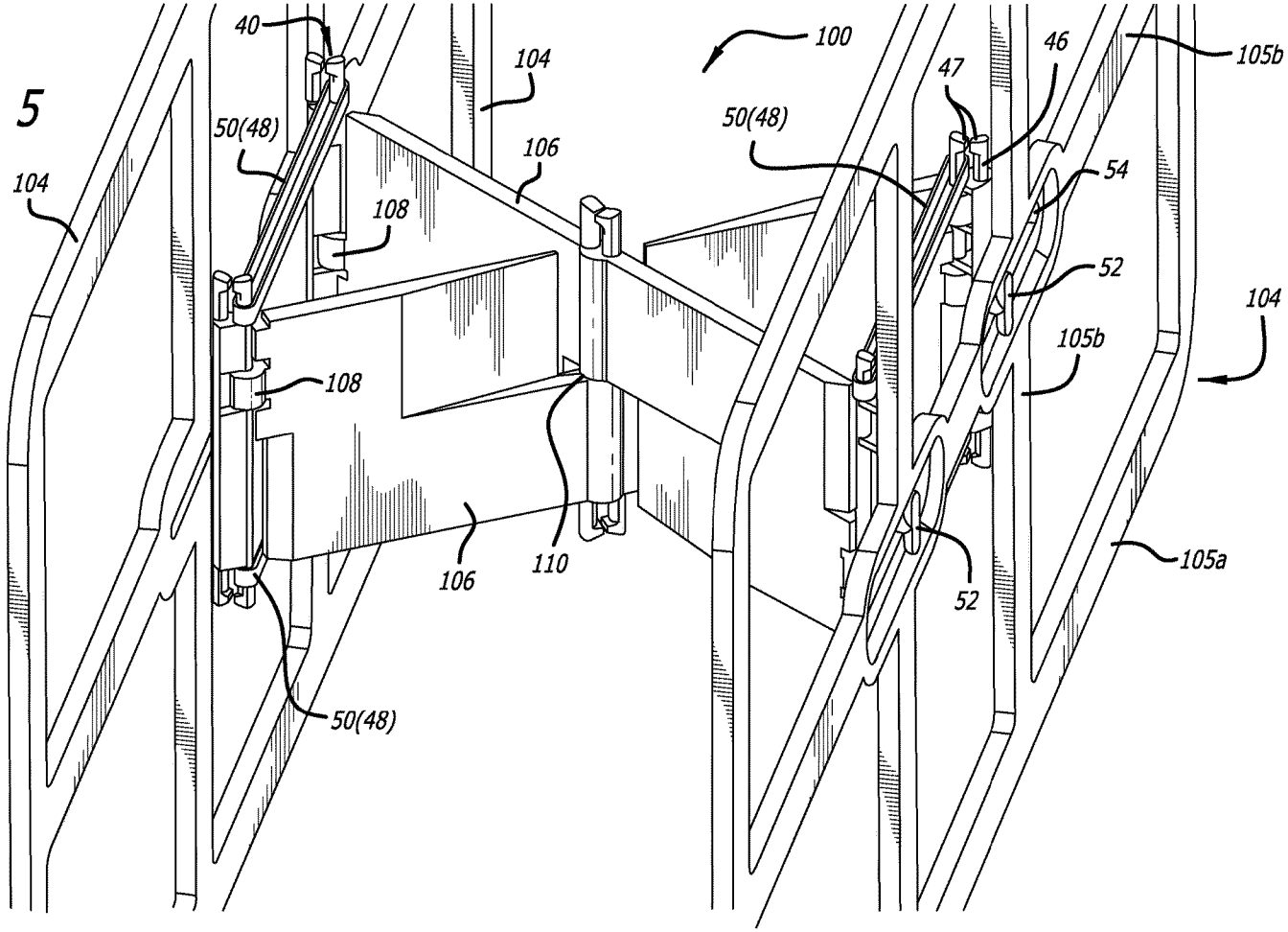
FIG. 5 is an isometric presentation in partial view of the first embodiment of the bag expander as expanded.

As best shown in FIGS. 5 and 9, crossing connecting members 106 are articulately connected at their centers by a hinged coupling or joint 110 comprising a pin 112 and an opening 114.

Figure 10:
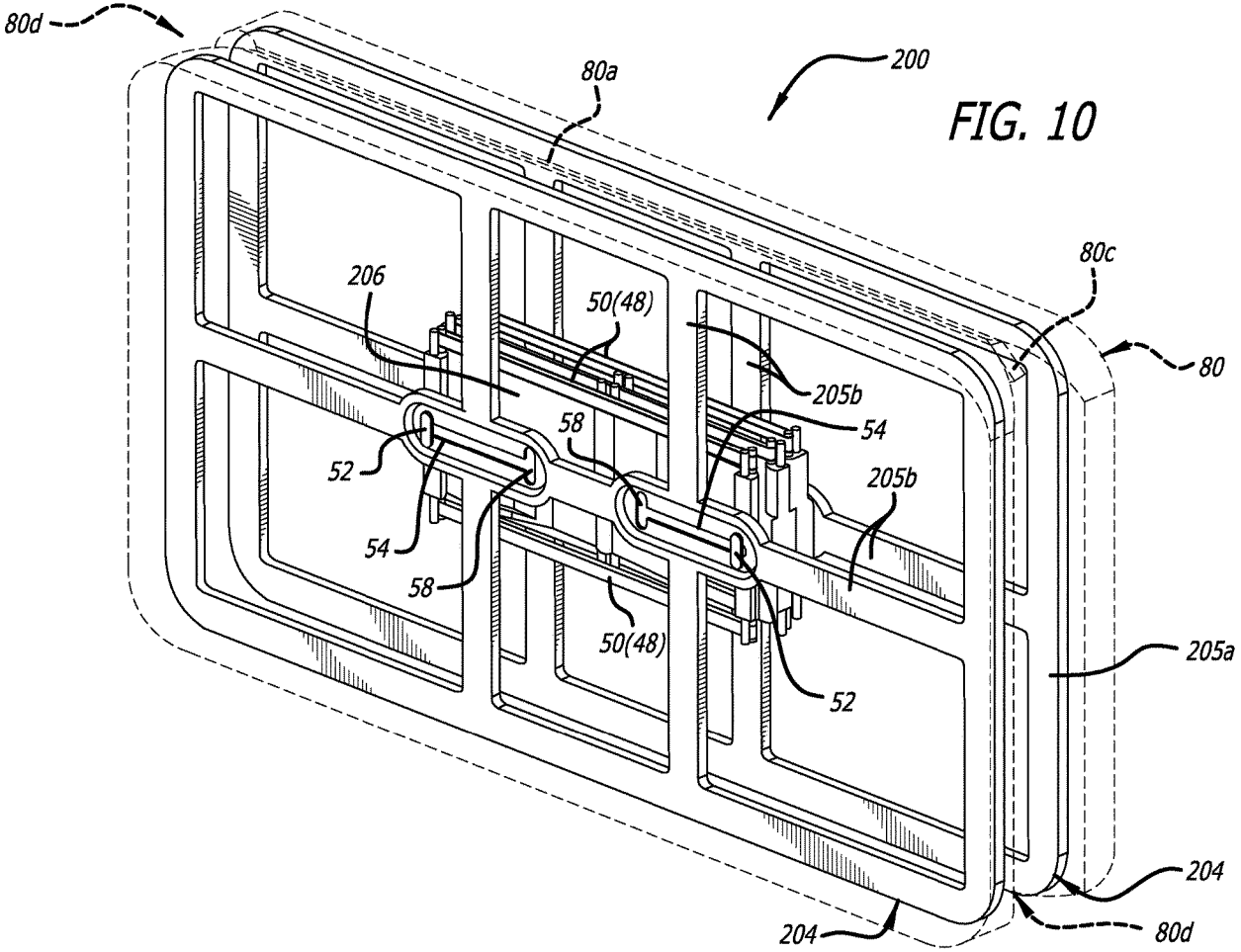
FIG. 10 is an isometric presentation of a second embodiment of the bag expander as compressed and contained in a receptacle or bag, which is depicted in phantom or dashed lines. Expansion of the bag expander is effected by an expansion motivator represented, as an example, in the form of a rubber band. The indicia utilized hereinafter in the second embodiment ranges within a 200 series.
Figure 11:
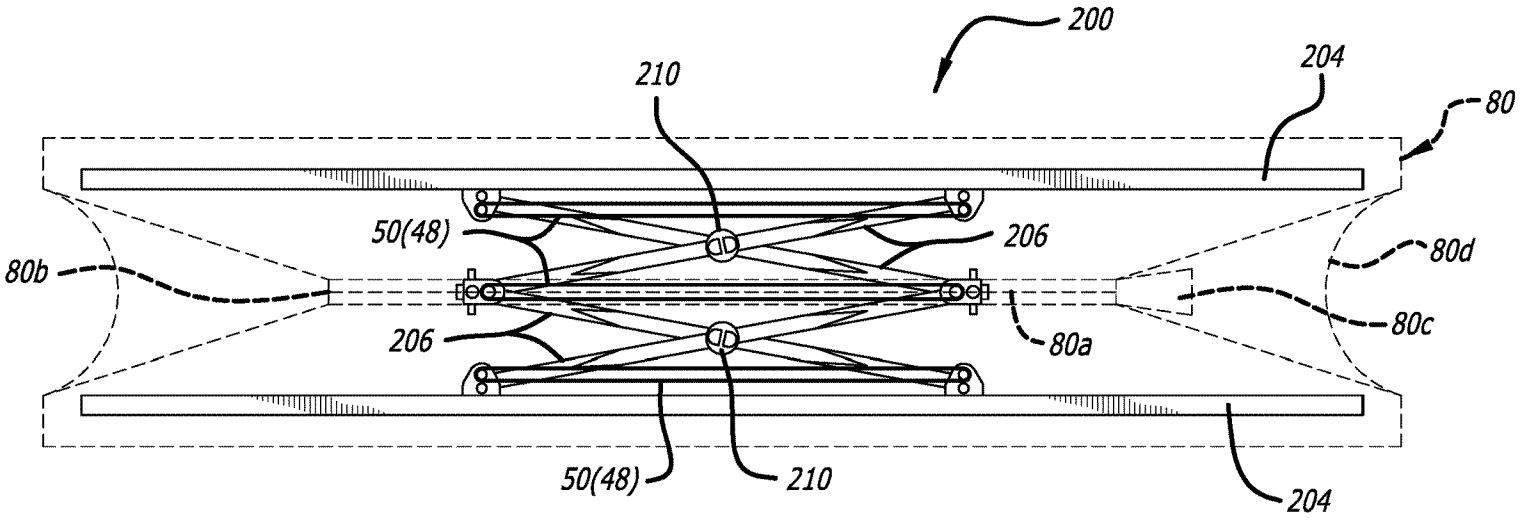
FIG. 11 is a top view of the second embodiment of FIG. 10 within the receptacle or bag, as fully compressed.
Figure 12:
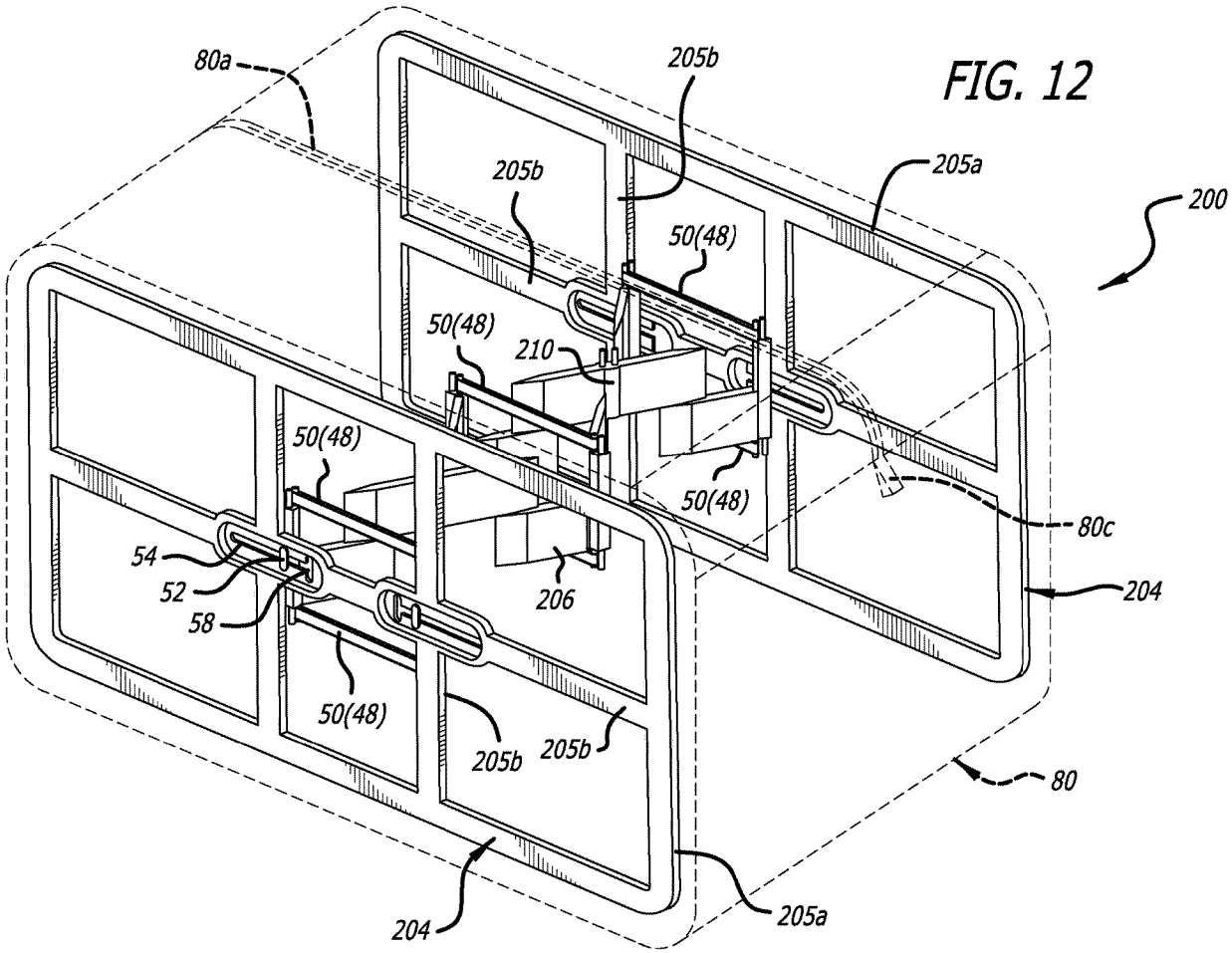
FIG. 12 is an isometric presentation of the second embodiment of FIG. 10 within the receptacle or bag, as fully expanded.
Figure 13:
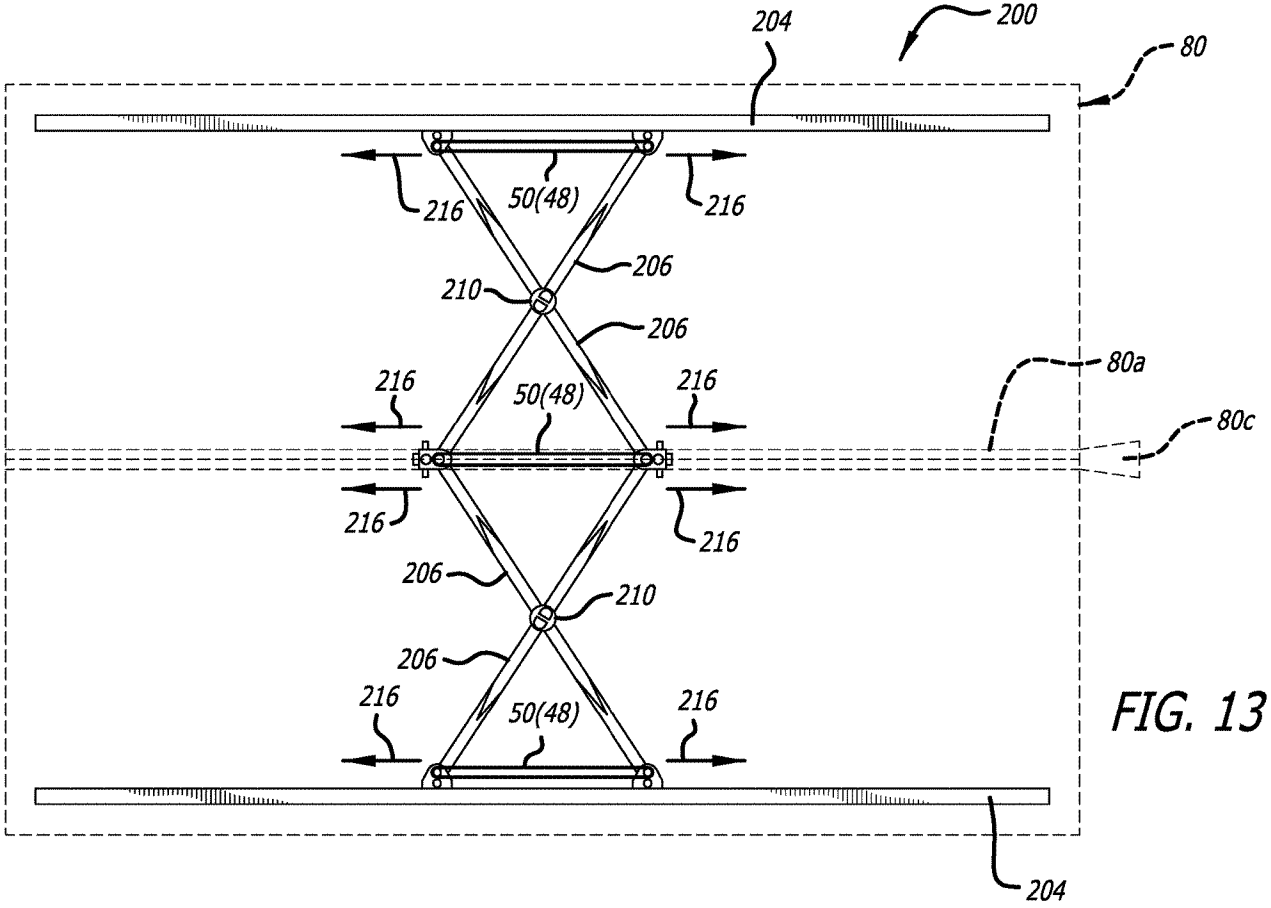
FIG. 13 is a top view of the second embodiment of FIG. 10 within the receptacle or bag, as fully expanded.
Figure 14:
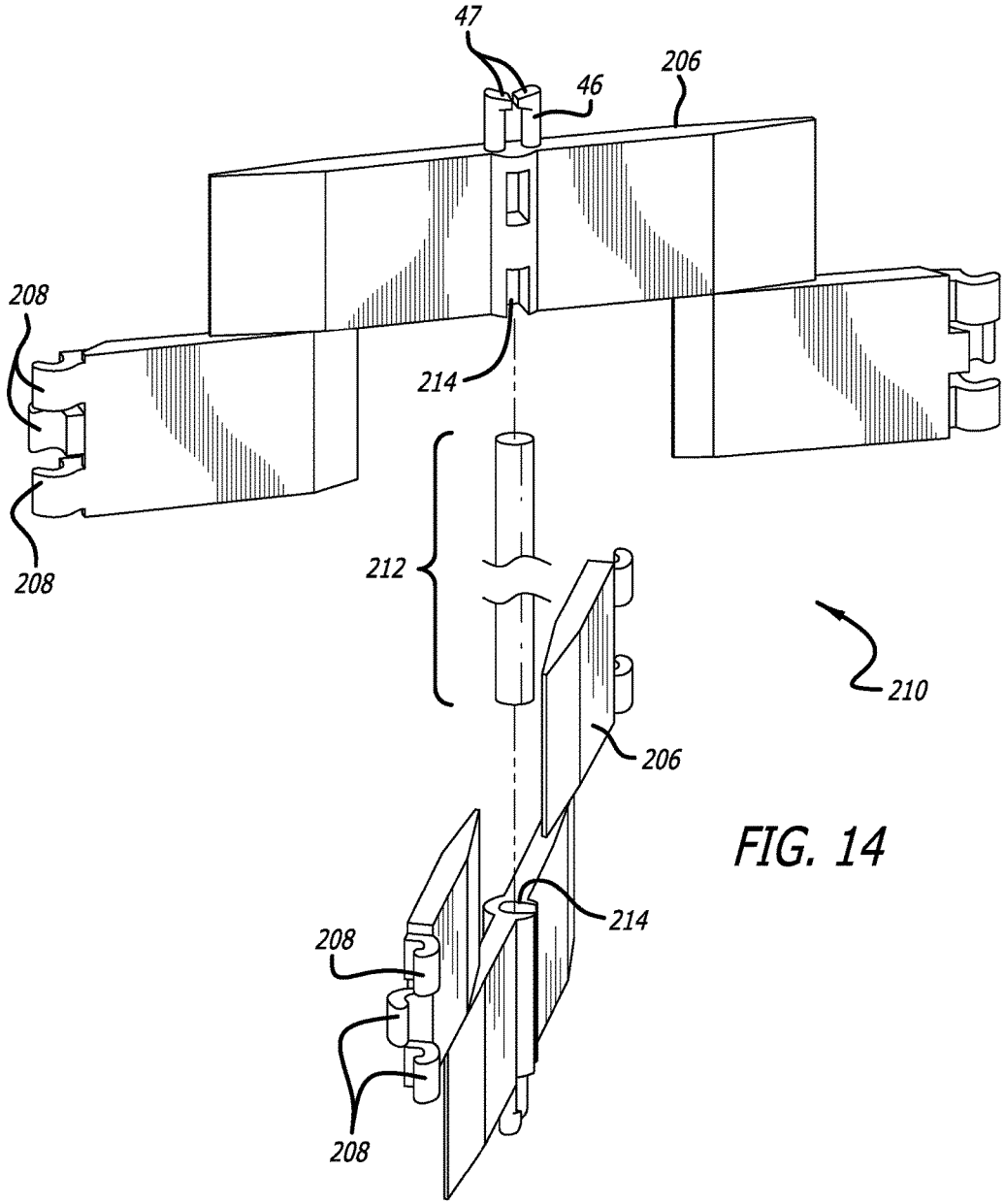
FIG. 14 is an exploded, isometric presentation of a pair of members used in the second embodiment of the bag expander.

Reference is now directed to the second embodiment comprising a bag extender 200 as illustrated in FIGS. 10-14. Bag expander 200 includes generally placed parallel sides 204 formed from a peripheral frame 205*a* and connecting links 205*b*. Sides 204 are coupled together by members 206, which are joined and articulated by a hinged coupling 210 into a configuration that has the shape of a diamond or half diamond (or triangle). FIG. 14 details elements of hinged coupling 210 including a pin 212 articulatedly joining members 206 in their openings 214. The respective coupling of members 206 to sides 204 are effected by the sliding mechanism which, as previously described, comprise slots 54 and entry openings 58 as also formed in this second embodiment in selected links 205*b*, and promontories or tongues 52. Expansion motivators 48, corporealized as rubber bands 50, couple modifications of axle pins 40 at their ends 46 and enable the bag expander to expand from being compressed as shown in FIGS. 10 and 11 to being fully deployed as illustrated in FIGS. 12 and 13 and to expand bag 80 and as suggested by arrow-headed lines 216 (see FIG. 13).

Figure 15:
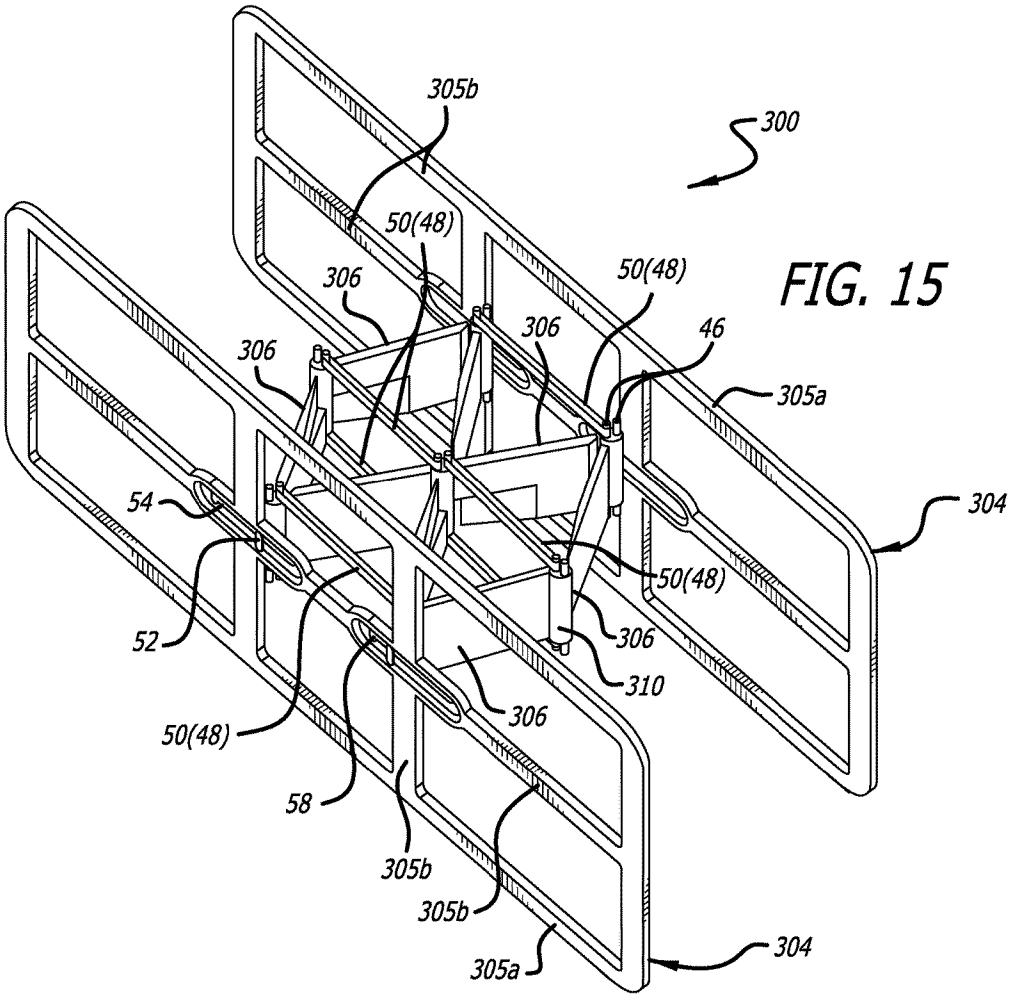
FIG. 15 is an isometric presentation of a third embodiment of the bag expander as expanded, which is to be contained in a receptacle or bag as depicted in prior figures. Expansion of the bag expander is effected by an expansion motivator represented, as an example, in the form of a rubber band. The indicia utilized hereinafter in the third embodiment ranges within a 300 series.
Figure 16:
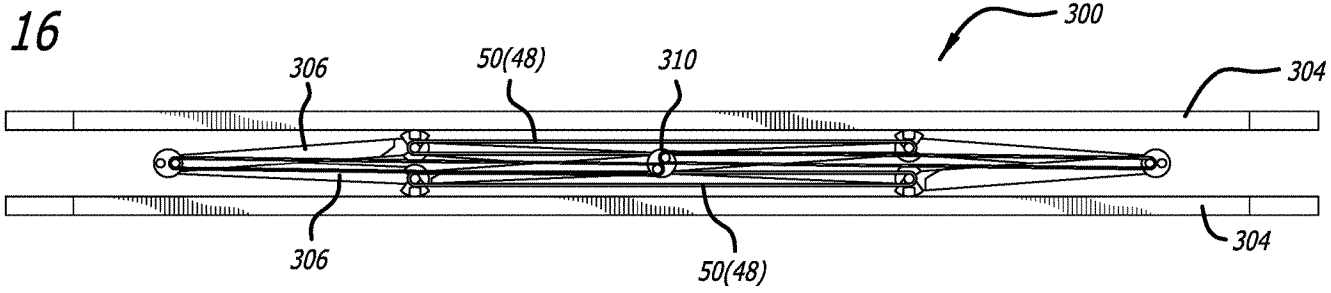
FIG. 16 is a top view of the third embodiment of FIG. 15 as fully compressed.
Figure 17:
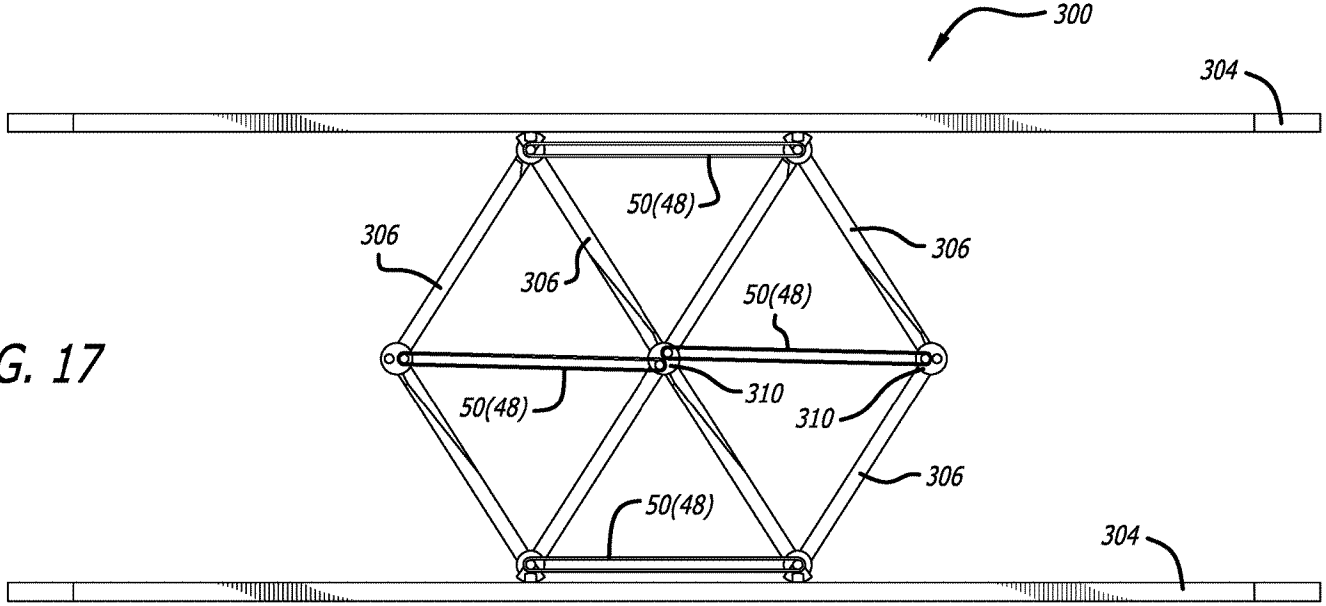
FIG. 17 is a top view of the third embodiment of FIG. 15 as fully expanded.

Reference is further directed to the third embodiment comprising bag extender 300 as illustrated in FIGS. 15-17. Bag expander 300 includes generally placed parallel sides 304 formed from a peripheral frame 305*a* and connecting links 305*b*. Sides 304 are coupled together by members 306, which are each joined and articulated by a hinged coupling 310 into a configuration that has the shape of parallel positioned double diamonds. The respective coupling of members 306 to sides 304 are effected by the sliding mechanism which, as previously described, comprise slots 54 and entry openings 58 as formed in selected links 305*b*, and promontories or tongues 52. Expansion motivators 48, which are corporealized as rubber bands 50, couple modifications of axle pins 40 at their ends 46 and enable the bag expander to expand from being compressed as shown in FIG. 16 to being fully deployed as illustrated in FIGS. 15 and 17 and thereby to expand a bag.

Figure 18:
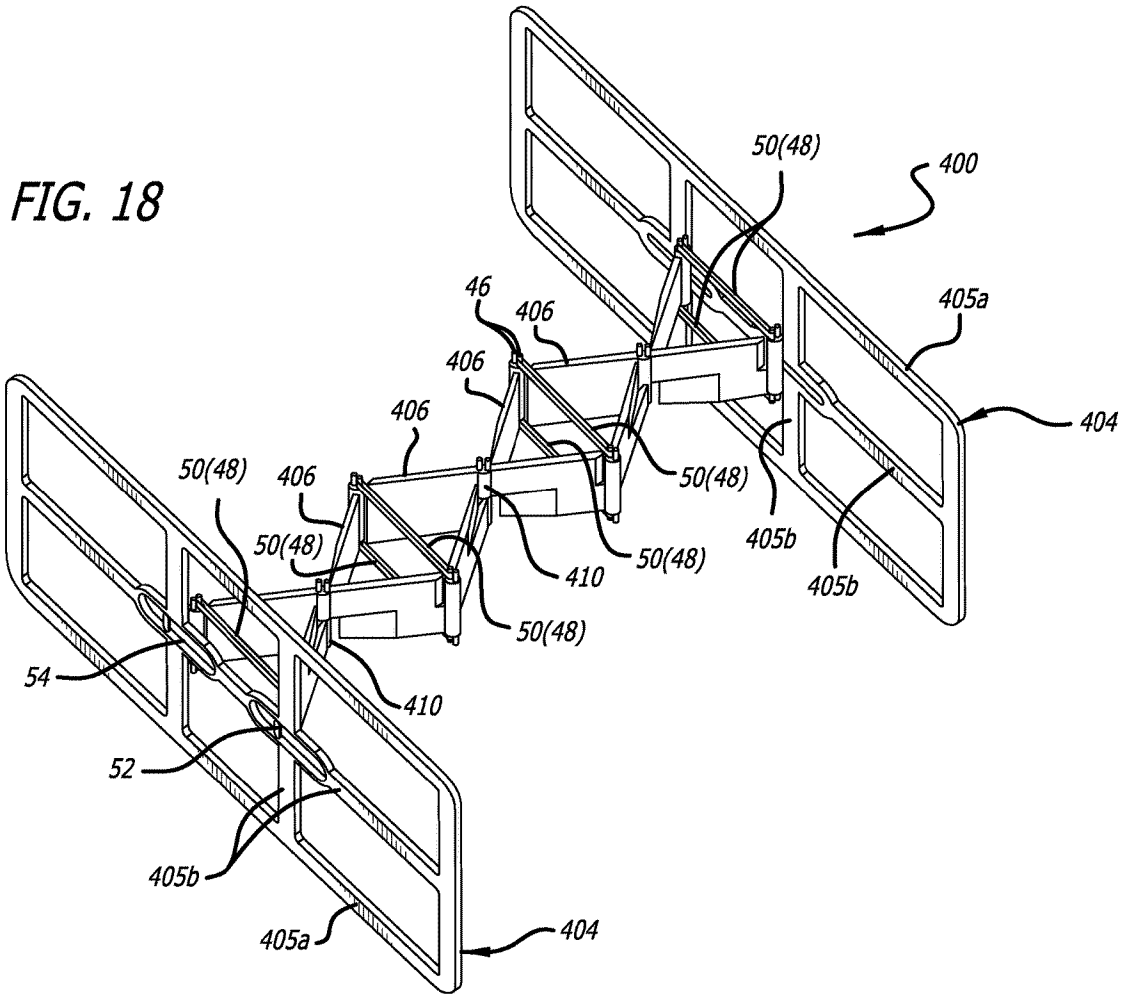
FIG. 18 is an isometric presentation of a fourth embodiment of the bag expander as expanded, which is to be contained in a receptacle or bag as depicted in prior figures. Expansion of the bag expander is effected by an expansion motivator represented, as an example, in the form of a rubber band. The indicia utilized hereinafter in the fourth embodiment ranges within a 400 series.
Figure 19:
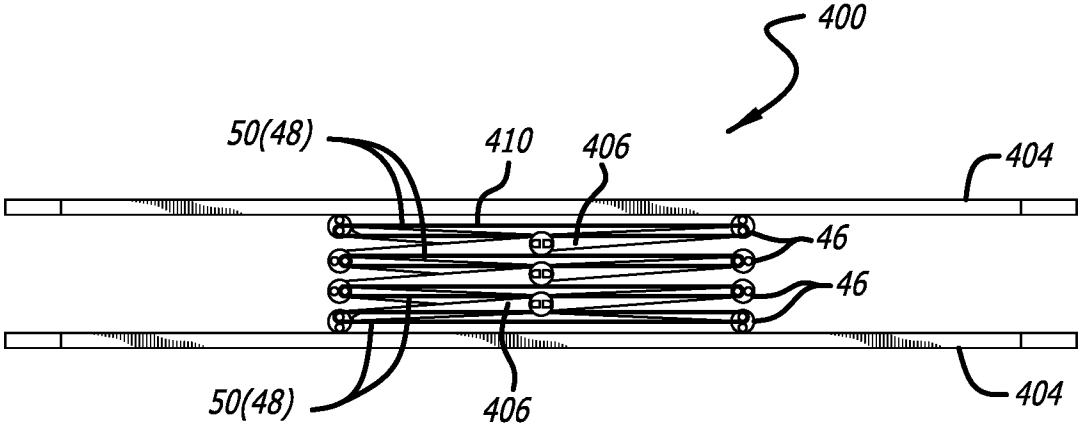
FIG. 19 is a top view of the fourth embodiment of FIG. 18 as fully compressed.
Figure 20:
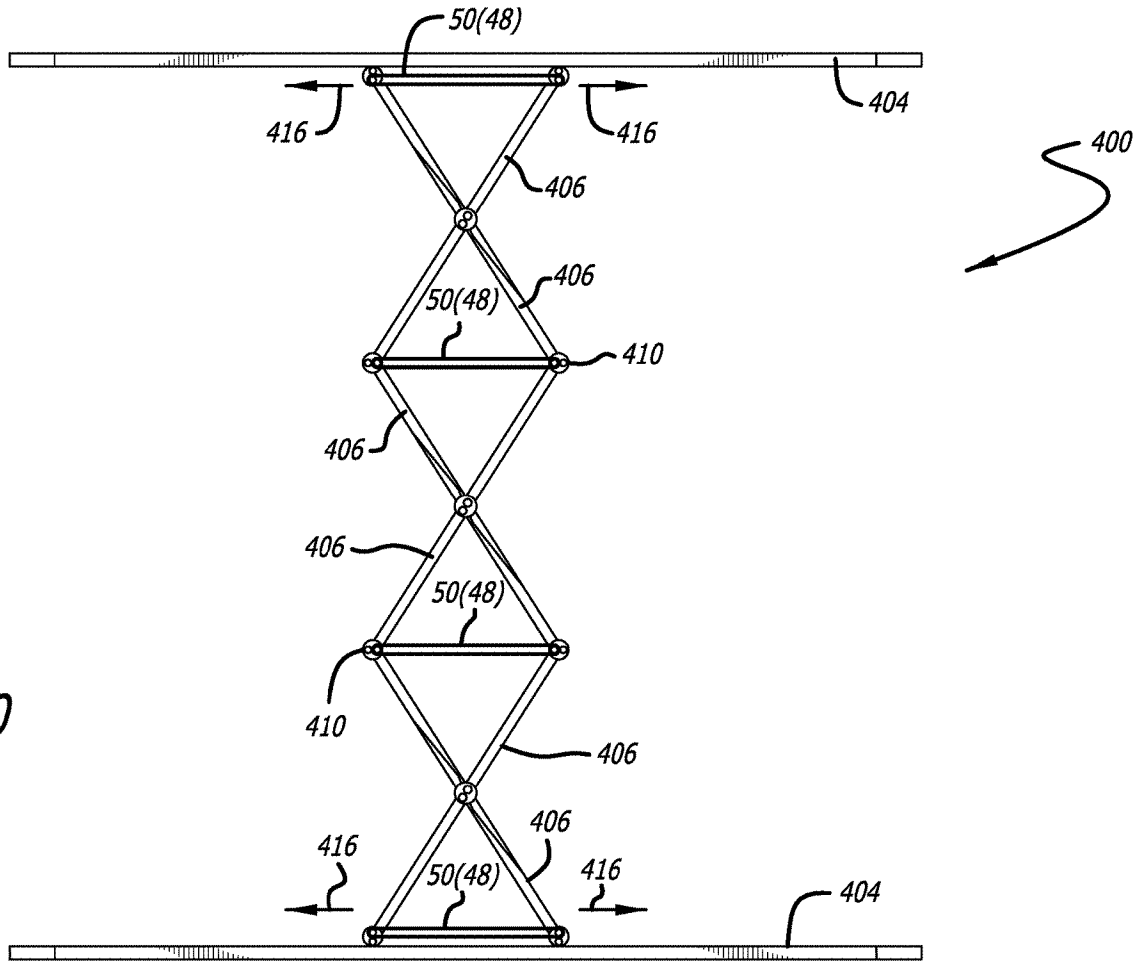
FIG. 20 is a top view of the fourth embodiment of FIG. 18 as fully expanded.

Reference to the fourth embodiment comprising bag extender 400 is illustrated in FIGS. 18-20. This embodiment is similar to that as described with respect to FIGS. 10-14; however, its members 406 are coupled into a serially connected diamond configuration, with its end members having a full diamond or triangular (half diamond) shape, and being coupled to its sides 404 by the sliding mechanism which, as previously described and illustrated, comprise slots 54 and entry openings 58 as formed in selected links 405*b*, and promontories or tongues 52. Expansion motivators 48, corporealized as rubber bands 50, couple several of the modifications of axle pins 40 at their ends 46 and enable the bag expander to expand from being compressed as shown in FIG. 19 to being fully deployed as illustrated in FIGS. 18 and 20 and to expand a bag and as suggested by arrow-headed lines 416 (see FIG. 20).

Figure 21:
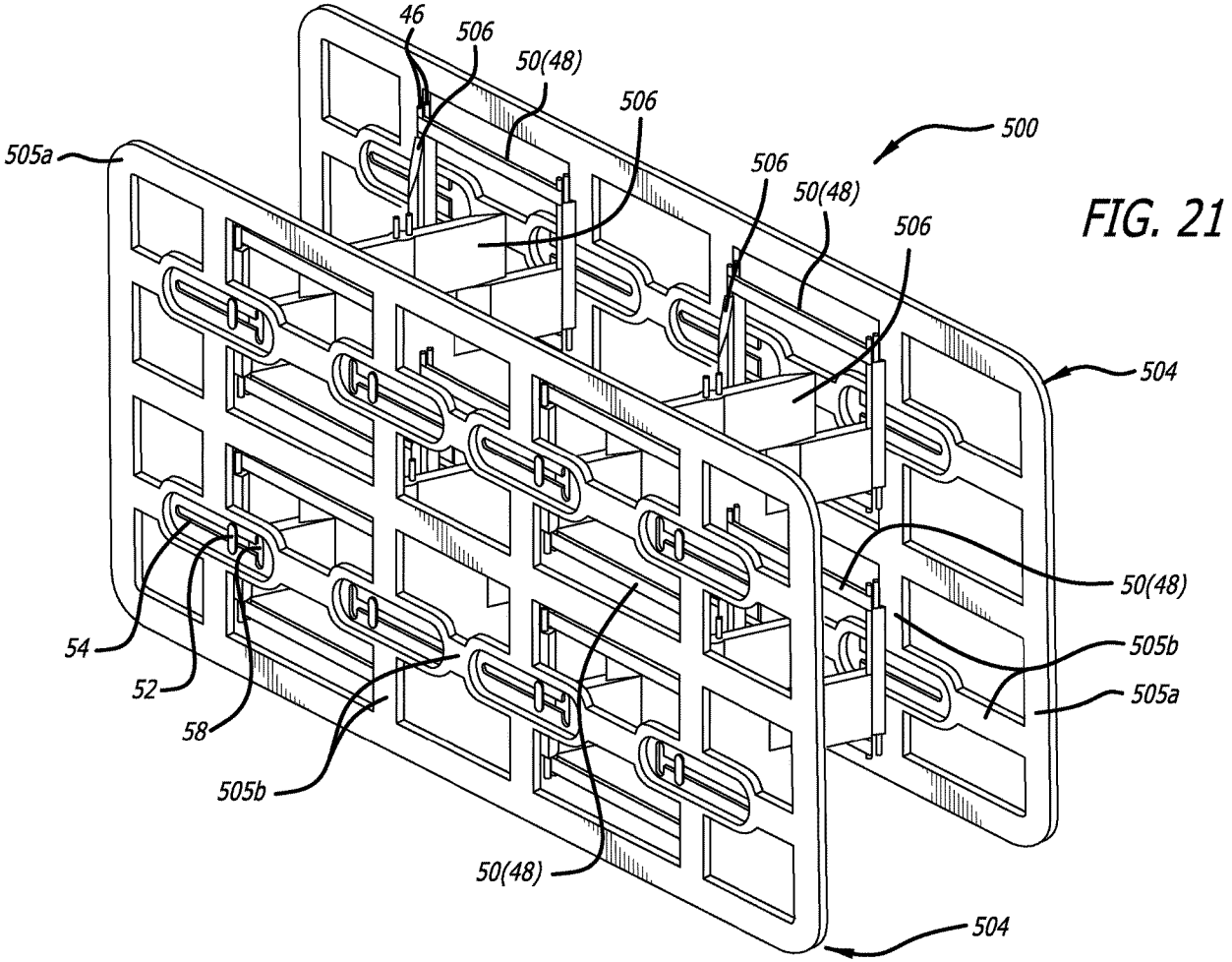
FIG. 21 is an isometric presentation of a fifth embodiment of the bag expander as expanded, which is to be contained in a receptacle or bag as depicted in prior figures. Expansion of the bag expander is effected by an expansion motivator represented, as an example, in the form of a rubber band. The indicia utilized hereinafter in the fifth embodiment ranges within a 500 series.
Figure 22:
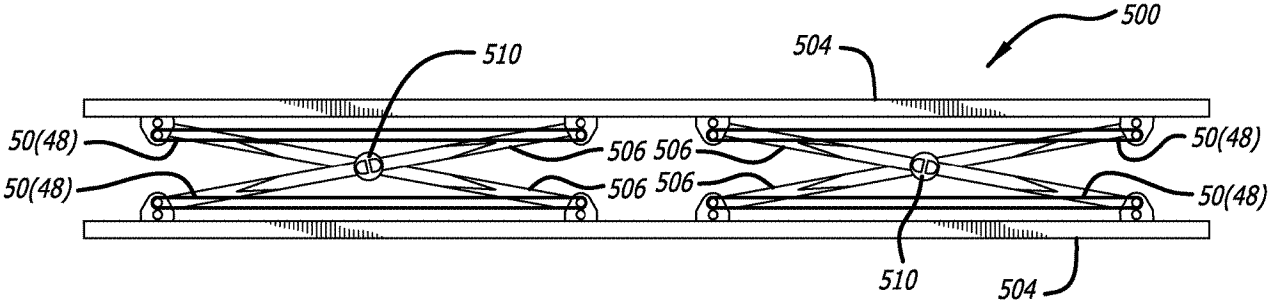
FIG. 22 is a top view of the fifth embodiment of FIG. 21 as fully compressed.
Figure 23:
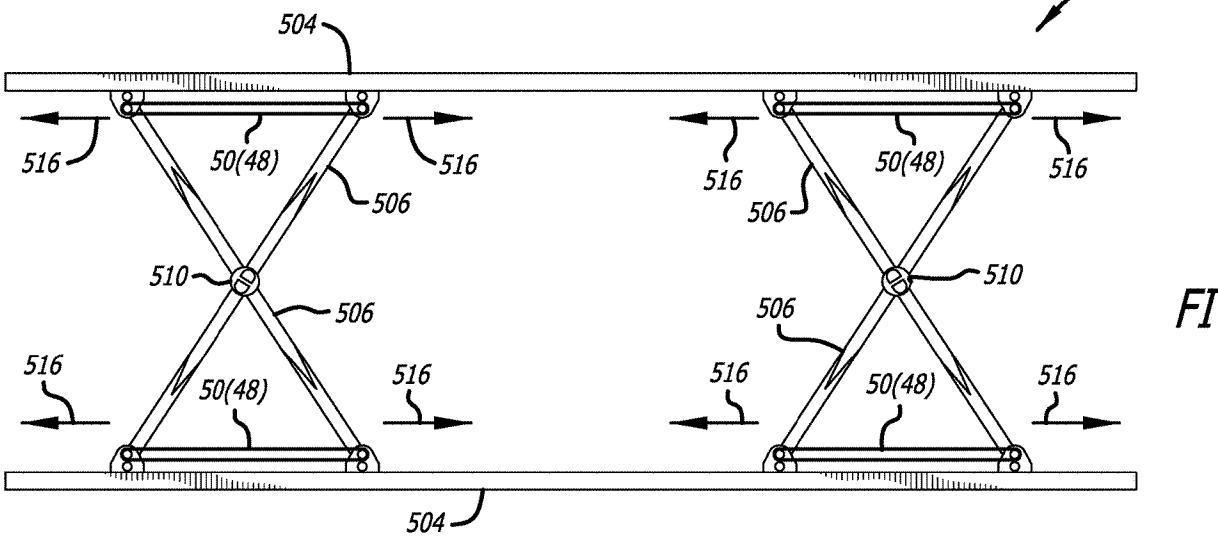
FIG. 23 is a top view of the fifth embodiment of FIG. 21 as fully expanded.

Reference is now directed to the fifth embodiment configured as a bag extender 500 as illustrated in FIGS. 21-23. Its members 506 are crossed at hinged couplings 510. This embodiment has a configuration which has similarities to those disclosed in the first (FIGS. 1-9) and third (FIGS. 15-17) embodiments. Here, crossed members 106 of the first embodiment, which are disposed in a single arrangement, in the fifth embodiment of FIGS. 21-23 are parallely coupled to sides 504. Similarly as before presented, crossing members 506 are coupled to its sides 504 by the sliding mechanism which, as previously described, comprise slots 54 and entry openings 58 as formed in selected links 505*b*, and promontories or tongues 52. Expansion motivators 48, corporealized as rubber bands 50, couple several of the modifications of axle pins 40 at their ends 46 and enable the bag expander to expand from being compressed as shown in FIG. 22 to being fully deployed as illustrated in FIGS. 21 and 23 and to expand a bag and as suggested by arrow-headed lines 516 as shown in FIG. 23.

Figure 24:
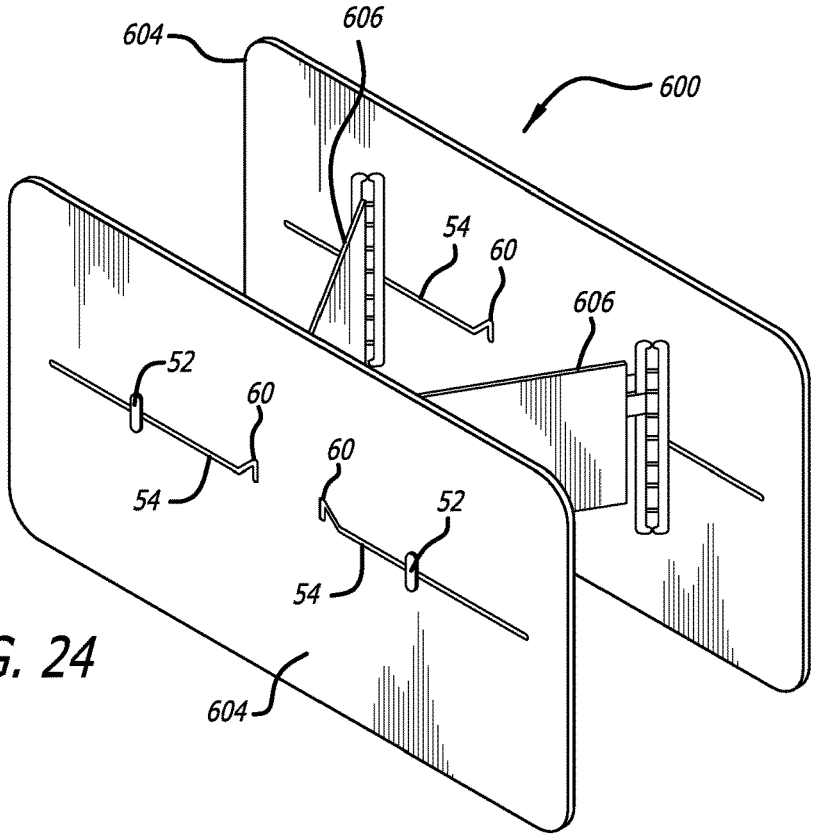
FIG. 24 is an isometric presentation of a sixth embodiment of the bag expander as expanded, which is to be contained in a receptacle or bag as depicted in prior figures, and additionally illustrating a first differently configured slot component of its sliding mechanism. The indicia utilized hereinafter in the sixth embodiment ranges within a 600 series.
Figure 25:
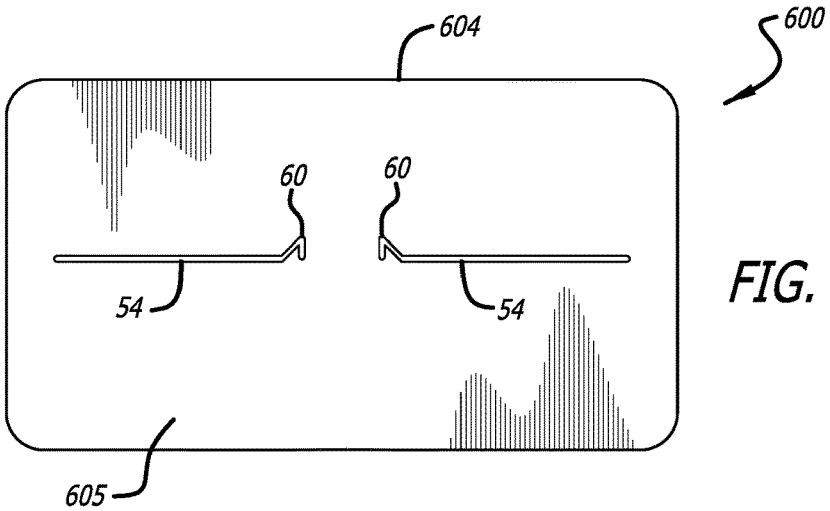
FIG. 25 is a side view of a side wall and its first differently configured slot component of the sixth embodiment shown in FIG. 24.

The sixth embodiment, comprising a bag extender 600, is shown in FIGS. 24 and 25. Its implementation is directed more to a more high-end market that the previously described and illustrated embodiments, such as may be contemplated as luxury items. Accordingly, side walls 604 may be constructed of polished wood or the like, and its connecting members 606 of metal, whether polished, lacquered or otherwise. As also before, connecting members 606 are coupled to side walls 604 by sliding mechanisms comprising promontories or tongues 52 on pin legs similar to previously described and illustrated axle pin legs 42 and slots 54. As an alternate to previously disclosed T-shaped slot entry opening 58, V-shaped slot entry openings 60 may be employed for receiving promontories or tongues 52. Otherwise, this sixth embodiment is similar to those previously described and illustrated.

Figure 26:
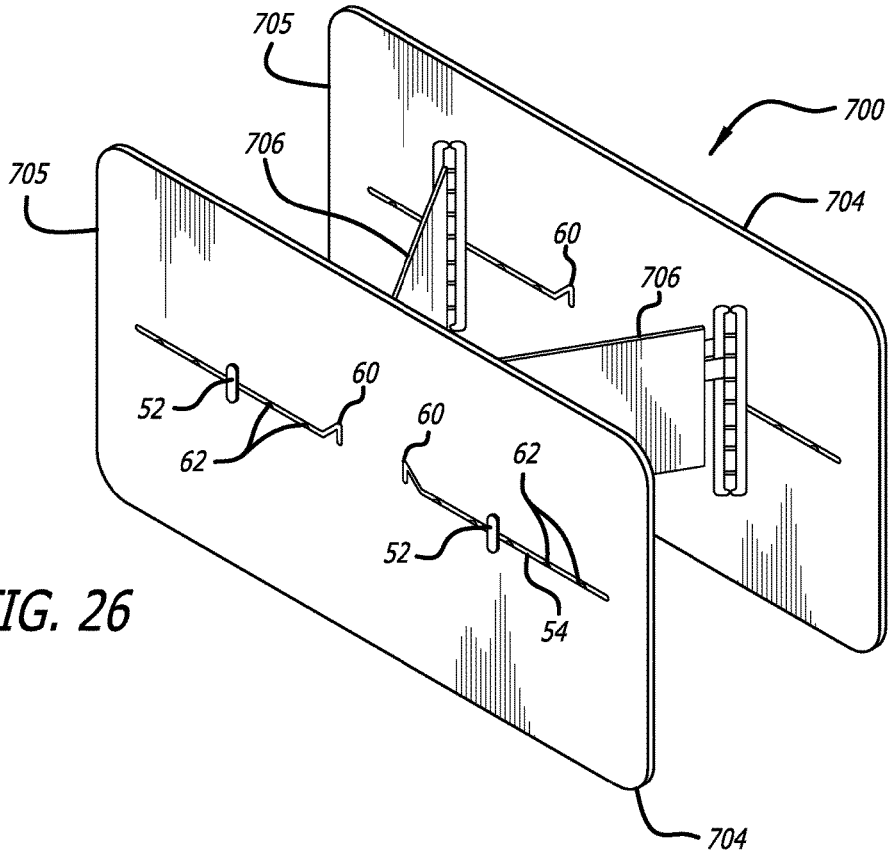
FIG. 26 is an isometric presentation of a seventh embodiment of the bag expander as expanded, which is to be contained in a receptacle or bag as depicted in prior figures but, while similar to that depicted in FIG. 24, additionally illustrating a second differently configured slot component of its sliding mechanism. The indicia utilized hereinafter in the seventh embodiment ranges within a 700 series.
Figure 27:
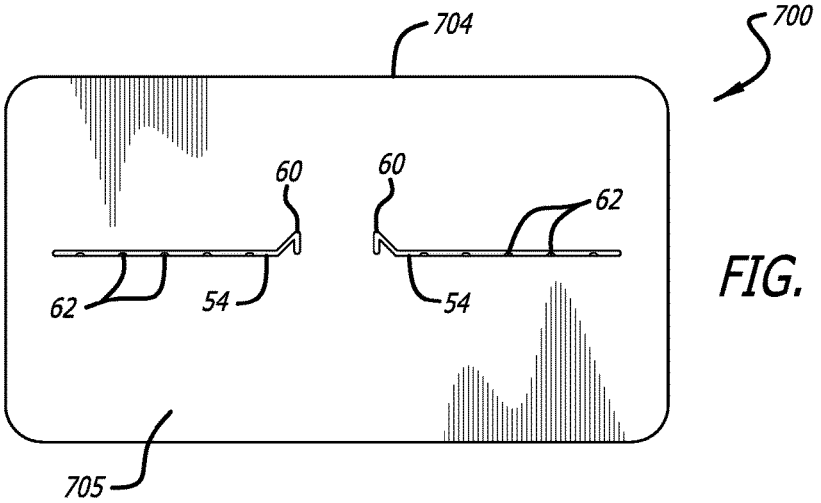
FIG. 27 is a side view of a side wall and its first differently configured slot component of the seventh embodiment shown in FIG. 26.

In the seventh embodiment of FIGS. 26 and 27, a bag extender 700 is similarly illustrated as that described with respect to that of FIGS. 24 and 25, with the addition of stops 62 placed within slots 54 formed in side walls 704 so as to prevent undesired sliding of promontories or tongues 52 in the slots.

Figure 28:
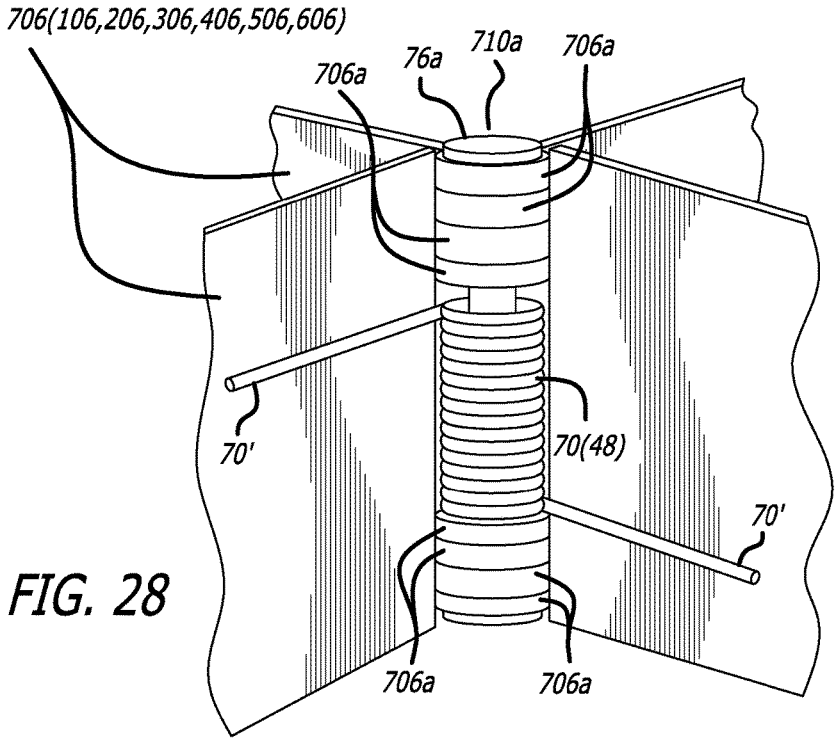
FIG. 28 is an isometric presentation of a second expansion motivator, configured as a single spring, useful particularly in the embodiments illustrated in FIGS. 24 and 26, rather than as embodied as a rubber band as shown in prior embodiments.
Figure 29:
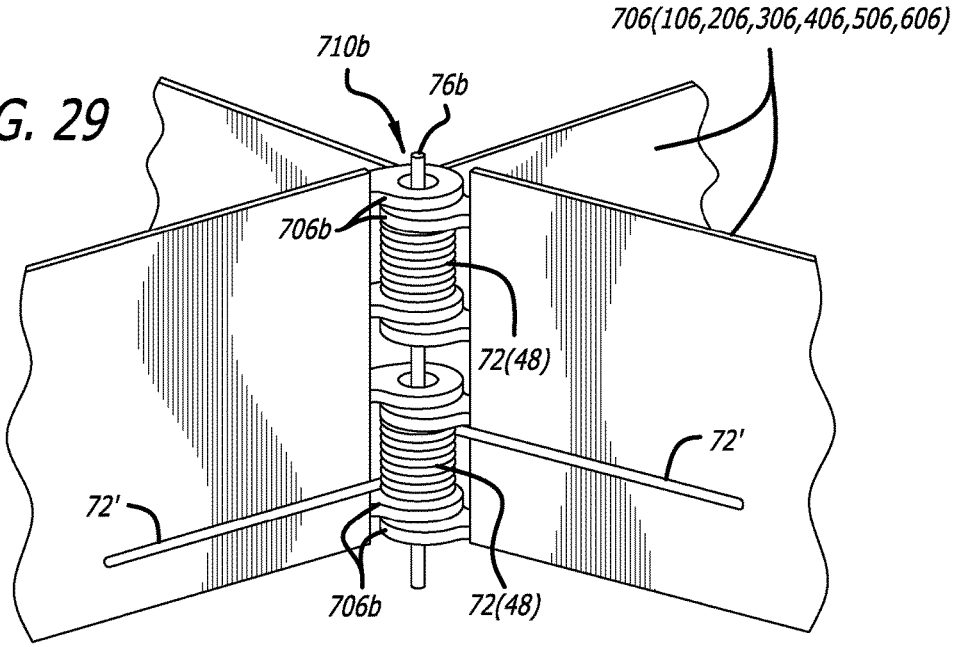
FIG. 29 is an isometric presentation of a second expansion motivator, configured as a double spring, useful particularly also in the embodiment illustrated in FIGS. 24 and 26, rather than as embodied as a rubber band as shown in prior embodiments.
Figure 30:
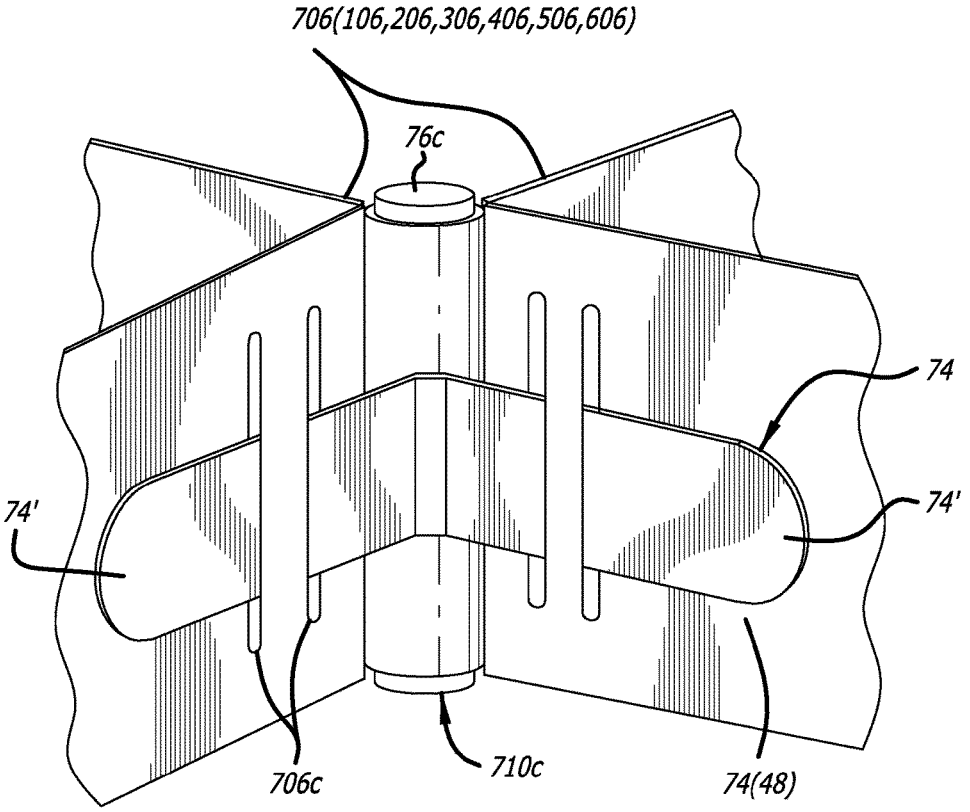
FIG. 30 is an isometric presentation of a third expansion motivator, configured as a leaf spring, useful particularly in the embodiments illustrated in FIGS. 24 and 26, rather than as embodied as a rubber band as shown in prior embodiments.

FIGS. 28-30 depict alternates of generalized expansion motivator 48 as embodied in previously described rubber bands 50. FIGS. 28-30 configure the expansion motivator as springs, specifically a single spring 70, a double spring 72 and a leaf spring 74. In FIG. 28, a hinged coupling 710*a* includes alternating pin-enclosure extensions 706*a* extending from crossing members 706 and a pin 76*a* (acting as an axle pin) extending through extensions 706*a*. Single spring 70 is centrally mounted about pin 76*a* and urges connecting members 706 to be biased apart through the intermediary of spring terminal extensions 70'. In FIG. 29, a hinged coupling 710*b* includes alternating pin-enclosure extensions 706*b* extending from crossing members 706 and a pin 76*b* (acting as an axle pin) extending through extensions 706*b*. Double spring 72 is centrally mounted about pin 76*b* and urges connecting members 706 to be biased apart through the intermediary of spring terminal extensions 72'. In FIG. 30, a hinged coupling 710*c* rotatably couples members 706 together. Slots 706*c* are provided in members 706 through which extensions 74' of leaf or flat spring 74 extend so that leaf or flat spring 74 can urge connecting members 706 to be biased apart. In the embodiments depicted in FIGS. 28-30, 710*a*, 701*b* and 710*c* form connecting points. While the specific expansion motivators of FIGS. 28-30 have been described as useful for the sixth and seventh embodiments of FIGS. 24-27, it is to be understood that they can equally be adapted to the first through seventh embodiments.

From the immediately preceding discussion, it is apparent that the earlier presented discussion, relating to the designations concerning "x (48)" where the letter "x" indicium was to be later identified as a numeral indicium, now has been satisfied with respect to the depiction of the specific expansion motivators as, for example, a rubber band "50 (48)" and for a spring "x (48)."

Figure 31:
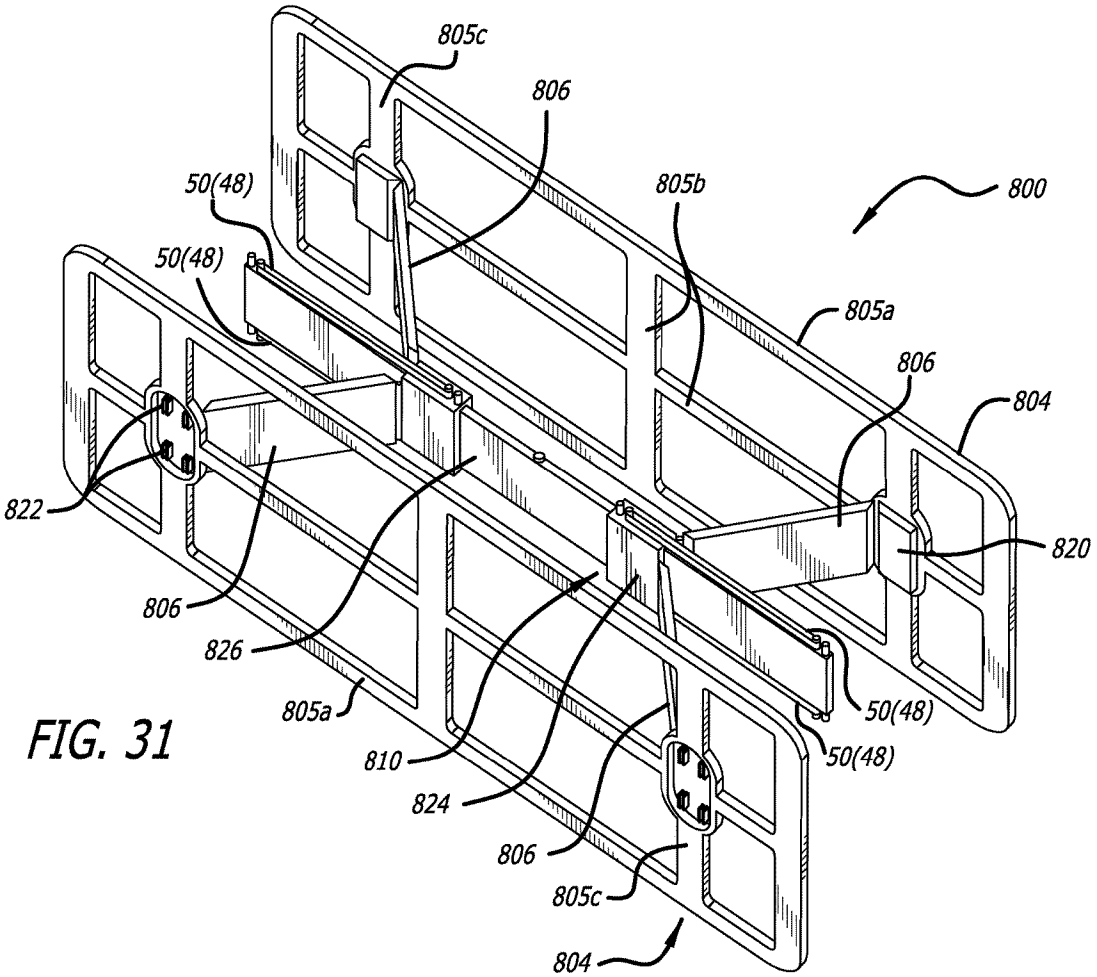
FIG. 31 is an isometric presentation of an eighth embodiment of the bag expander as expanded, which is to be contained in a receptacle or bag as depicted in prior figures and illustrating a second sliding mechanism. Expansion of the bag expander is effected by an expansion motivator represented, as an example, in the form of a rubber band. The indicia utilized hereinafter in the eight embodiment ranges within an 800 series.
Figure 32:
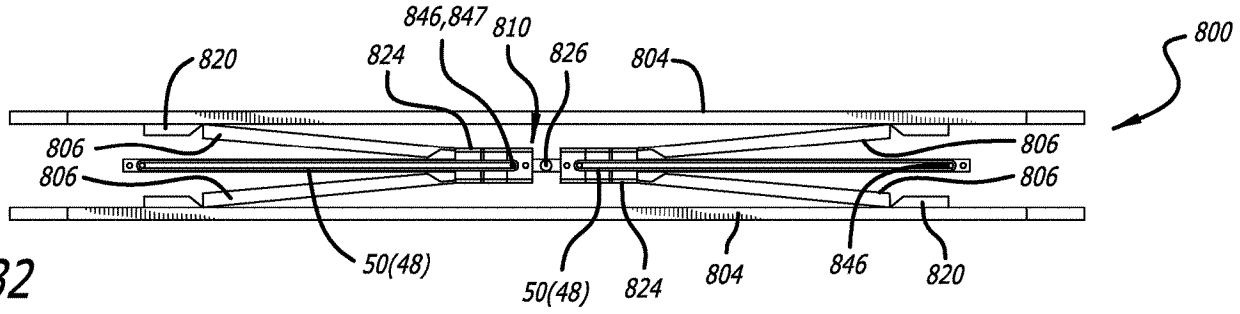
FIG. 32 is a top view of the eighth embodiment as shown in FIG. 31 as fully compressed, which is to be contained in a receptacle or bag as depicted in prior figures.
Figure 33:
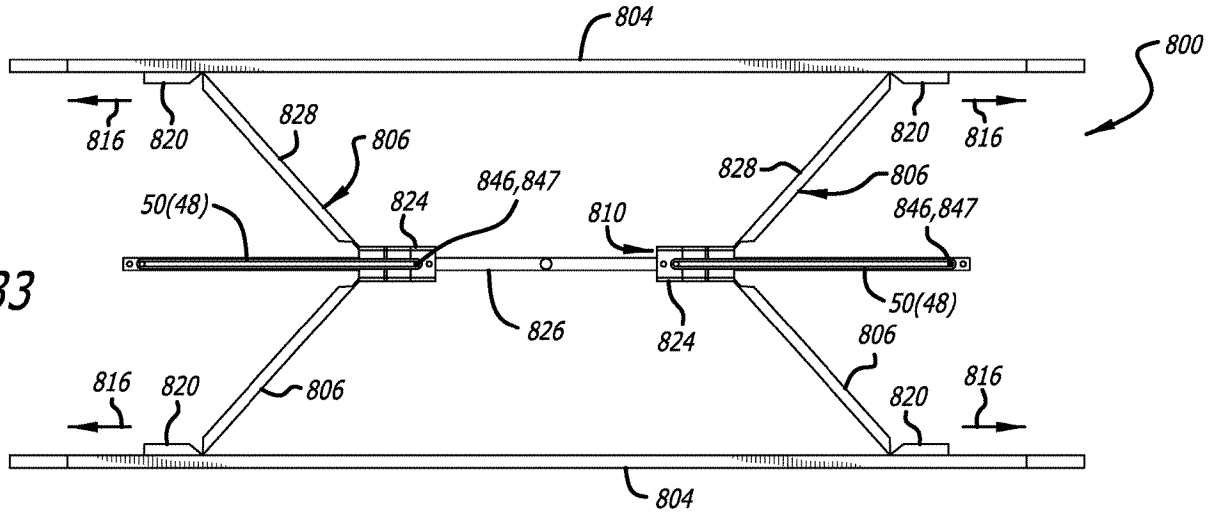
FIG. 33 is a top view of the eighth embodiment as shown in FIG. 31 as fully expanded, which is to be contained in a receptacle or bag as depicted in prior figures.

Reference is now directed to the eighth embodiment comprising a bag extender 800 as illustrated in FIGS. 31-33, and presents a sliding mechanism or coupler alternate to that previously espoused. Bag expander 800 comprises side walls 804, members 806 joining the side walls, and a sliding mechanism coupling 810 between members 806. Members 806 are connected at one of their ends (first termini) by a tab 820 affixed by elements 822 secured within holes provided in selected links 805*b* of frames 804 in a manner similar to that previously described and illustrated. At the end or second termini of members 806, opposite from member tabs 820, are a pair of sleeves or couplers 824. An interjacent member or slide 826 is interjacently is positioned between sleeves 824 and is disposed to slide therewithin. Accordingly, the interaction between sleeves 824 and interjacent member or slide 826 provides the sliding mechanism of this eighth embodiment. While member 806 is depicted as a single moulded plastic piece and as comprising a central portion 828 coupling tabs 820 and sleeves 824 joined by a thin element, member 806 can be otherwise formed. Sleeves 824 and slides 826 are formed with ends 846 having projections 847, similar to those of axle pins 40. Expansion motivators 48, corporealized as rubber bands 50, couple several of ends 846 between sleeves 824 and slides 826 and enable the bag expander to expand from being compressed as shown in FIG. 32 to being fully deployed as illustrated in FIG. 33 and to expand a bag and as suggested by arrow-headed lines 816 as depicted in FIG. 33.

Although the invention has been described with respect to particular embodiments thereof, it should be realized that various changes and modifications may be made therein without departing from the spirit and scope of the invention.

What is claimed is:

1. A bag expander for enabling its insertion into a bag when the bag is in a compressed condition and its expansion of the bag when the bag is to be positioned into an expanded deployed condition, comprising:

side walls positionable against the bag interior;

members articularly connected together and coupled to said side walls to form articulate connections therebetween, in which said articulate connections include axle pins wherein each said axle pin comprises a pair of parallely extending legs joined together by a plurality of spaced connecting pieces forming connecting points;

an expansion motivator associated with said members enabling expansion thereof from the bag compressed condition to its expanded condition, wherein said side walls are thus enabled to remain in contact with the bag interior, said members having a folded condition when the bag is in its compressed condition and having an expanded condition when the bag is in its expanded deployed condition;

sliding mechanisms associated with said members and said side walls providing a selected sliding movement thereamongst enabling the insertion and expansion; and said axle pins having said connecting points which are formed at ends of each of said parallely extending legs for receiving said expansion motivator and for being biased thereby.

2. The bag expander according to claim 1 wherein said members comprise substantially inflexible material and said articulate connections comprise joints including said axle pins (a) between said members and (b) between said members and said side walls through said sliding mechanisms.

3. The bag expander according to claim 2 wherein said joints include said axle pins which respectively join said members and said side walls and which are spaced from one another, said axle pins having said connecting points, and in which said expansion motivator comprises rubber band-type devices coupled to opposed ones of said axle pin connecting points.

4. The bag expander according to claim 3 in which (a) said members, as articulated together, terminate in alternately-directed generally C-shaped closures, (b) each said axle pin comprises said pair of parallely extending legs joined together by said plurality of spaced connecting pieces forming said connecting points to which said C-shaped closures are pivotally connected, and (c) said axle pin connecting points are formed at said ends of each of said parallely extending legs for receiving said rubber band-type devices and biased thereby.

5. The bag expander according to claim 4 wherein said material comprises a plastic material.

6. The bag expander according to claim 4 wherein said material forming said side walls comprises wood and said material forming said members comprises metal.

7. The bag expander according to claim 1 wherein said sliding mechanisms are positioned between at least one of said members and said side walls.

8. The bag expander according to claim 7 wherein said sliding mechanisms comprise slots in said side walls and promontories in said axle pins.

9. The bag expander according to claim 8 wherein said members comprise substantially inflexible material and said articulate connections comprise joints including said axle pins (a) between said members and (b) between said members and said side walls through said sliding mechanisms.

10. The bag expander according to claim 7 wherein:

said side walls are disposed in generally parallel planes and planarly movable towards and away from one another along an axis which is generally perpendicular to their planes;

said sliding mechanisms comprise parallely extending long, narrow cuts in said side walls, which cuts are generally perpendicular to the axis, and promontories extending from said axle pins and into said cuts.

11. The bag expander according to claim 10 wherein said promontories are shaped as having one of a T-configuration and an L-configuration.

12. The bag expander according to claim 10 wherein said joints include said axle pins which respectively join said members and said side walls and which are spaced from one another, said axle pins having said connecting points, and in which said expansion motivator comprises rubber band-type devices coupled to opposed ones of said axle pin connecting points.

13. The bag expander according to claim 12 in which (a) said members, as articulated together, terminate in alternately-directed generally C-shaped closures, (b) each said axle pin comprises said pair of parallely extending legs joined together by said plurality of spaced connecting pieces forming said connecting points to which said C-shaped closures are pivotally connected, (c) said axle pin connecting points are formed at said ends of each of said parallely extending legs for receiving said rubber band-type devices and biased thereby, and (d) said promontories extend from those of said axle pins that are between said members and said side walls.

14. The bag expander according to claim 13 in which at least ones of said members are coupled together to form a diamond-shaped configuration and others of said members extend from said diamond-shaped configuration and are coupled to said side walls.

15. The bag expander according to claim 1 wherein at least some of said members are coupled together to form a diamond-shaped configuration.

16. The bag expander according to claim 15 in which said diamond-shaped configuration members are configured as flat members having ends, and in which said sliding mechanism comprises slots in said side walls and promontories formed in said axle pins.

17. The bag expander according to claim 16 wherein said axle pins join said flat members and are spaced from one another, said axle pins having said connecting points, and in which said expansion motivator comprises rubber band-type devices coupled to opposed ones of said axle pin connecting points.

18. The bag expander according to claim 15 in which said members are pivotally joined together and to said side walls to form the articulate connections.

19. The bag expander according to claim 18 further including at least second ones of said members which are formed into a second diamond-shaped configuration and which are articulately joined to one of said at least some of said members, and in which said second diamond-shaped configuration (a) is also articulately joined to said side walls, (b) is similarly constructed as said first-mentioned diamond-shaped configuration and (c) biased by said expansion motivator.

20. The bag expander according to claim 15 in which said members comprise two members coupled at a first of said side walls by a first of said sliding mechanisms and two members coupled at a second of said side walls by a second of said sliding mechanisms.

21. The bag expander according to claim 15 further including at least a further second of said members coupled together to form a second diamond-shaped configuration which said first-mentioned and second diamond-shaped configurations are serially coupled together.

22. The bag expander according to claim 1 in which (a) said members, as articulated together, terminate in alternately-directed generally C-shaped closures, (b) said C-shaped closures are pivotally adapted to be connected to said axle pins, (c) said expansion motivator comprises rubber bands, and (d) said axle pins having said connecting points which are formed at said ends of each of said parallely extending legs for receiving said rubber bands and for being biased thereby.

23. The bag expander according to claim 1 in which said members comprise at least one pair of crossing members and in which said at least one pair of said crossing members defines a crossing connection and said articulate connections comprise (a) a joint between said at least one pair of said crossing members at said crossing connection and (b) joints including said axle pins between said at least one pair of said crossing members and said side walls through said sliding mechanisms.

24. The bag expander according to claim 23 wherein said joints between said members and said side walls through said sliding mechanisms include said axle pins which join said members and said side walls, said axle pins having said connecting points, and in which said expansion motivator comprises rubber band-type devices coupled to opposed ones of said axle pin connecting points.

25. The bag expander according to claim 23 in which (a) said members, as articulated together, terminate in alternately-directed generally C-shaped closures, (b) said articulate connections include said axle pins wherein each said axle pin comprises said pair of parallely extending legs joined together by said plurality of spaced connecting pieces forming said connecting points to which said C-shaped closures as connected to each said axle pin are pivotally connected, (c) said expansion motivator comprises rubber bands, and (d) said axle pins having said connecting points which are formed at said ends of each of said parallely extending legs for receiving said rubber bands and for being biased thereby.

26. The bag expander according to claim 23 in which:

said members comprise at least a second pair of crossing members and in which said at least said second pair of said crossing members defines a crossing connection and said articulate connections comprise (a) a joint between said at least said second pair of said crossing members at said crossing connection and (b) joints including said axle pins between said at least said second pair of said crossing members and said side walls through said sliding mechanisms; and said at least one pair of said crossing members and said at least said second pair of said crossing members are parallely coupled to said side walls.

27. A bag expander method for enabling insertion of a bag expander into a bag when the bag is in a compressed condition and for enabling expansion of the bag when the bag is to be positioned into an expanded deployed condition, comprising the steps of:

positioning side walls against the bag interior;

articularly connecting members together and to the side walls for enabling the side walls to remain in contact with the bag interior and for enabling the insertion and expansion, in which said articularly connecting step includes the step of axially pinning by use of a pair of parallely extending legs joined together by a plurality of spaced connecting pieces forming connecting points;

placing the members in a folded condition when the bag is in its compressed condition and in an expanded condition when the bag is in its expanded deployed condition;

associating a sliding mechanism with the members and the side walls to provide a selected sliding movement thereamongst in association with the insertion and expansion enabling; and motivating expansion of the members to enable the expansion.

28. The bag expander method according to claim 27 in which the sliding mechanism associating step comprises the step of positioning the sliding mechanism between the members and the side walls.

29. The bag expander method according to claim 27 further comprising the step of coupling at least some of the members together to form a diamond-shaped configuration.

30. The bag expander method according to claim 29 further comprising the steps of:

forming at least other of the members into a second diamond-shaped configuration which is articularly joined to one of the at least some one of the members;

articulately joining the second diamond-shaped configuration also to the side walls in parallel with the first-mentioned diamond-shaped configuration;

similarly constructing the second diamond-shaped configuration as the first-mentioned diamond-shaped configuration; and biasing the first and second diamond-shaped configurations.

31. The bag expander method according to claim 27 further comprising the steps of:

configuring at least one pair of the connecting members as crossing members; and defining the at least one pair of the crossing members as a crossing connection; and in which the articularly connecting step comprises the steps of:

effecting (a) a joint between the at least one pair of the crossing members at the crossing connection and (b) joints by the step of axially pinning between the at least one pair of the crossing members and the side walls through the sliding mechanisms.

* * * * *